US007578631B2

(12) United States Patent
Kurita et al.

(10) Patent No.: US 7,578,631 B2
(45) Date of Patent: Aug. 25, 2009

(54) DIRECT-FLUID-SUPPLY WRITING IMPLEMENT

(75) Inventors: Tetsuhiro Kurita, Aichi (JP); Takao Inaba, Aichi (JP)

(73) Assignee: The Pilot Ink Co., Ltd., Aichi (JP)

( * ) Notice: Subject to any disclaimer, the term of this patent is extended or adjusted under 35 U.S.C. 154(b) by 623 days.

(21) Appl. No.: 11/225,055

(22) Filed: Sep. 14, 2005

(65) Prior Publication Data

US 2006/0054036 A1 Mar. 16, 2006

(30) Foreign Application Priority Data

Sep. 14, 2004 (JP) ..... P.2004-267491
Feb. 2, 2005 (JP) ..... P.2005-026768
Feb. 2, 2005 (JP) ..... P.2005-026769

(51) Int. Cl.
*B43K 5/00* (2006.01)

(52) U.S. Cl. ..... 401/198; 401/223

(58) Field of Classification Search ..... 401/198, 401/199, 223, 224, 225
See application file for complete search history.

(56) References Cited

U.S. PATENT DOCUMENTS 5,026,189 A 6/1991 Keil
5,290,116 A 3/1994 Chang
5,454,658 A 10/1995 Kato
5,971,646 A 10/1999 Chavatte et al.
6,086,279 A * 7/2000 Yen ..... 401/202
6,497,527 B2 * 12/2002 Kaufmann ..... 401/198
6,599,046 B2 7/2003 Fukushima et al.
6,695,517 B2 * 2/2004 Witz et al. ..... 401/198

FOREIGN PATENT DOCUMENTS

JP 45-18890 8/1970
JP 56-7504 Y2 2/1981
JP 60-7191 Y2 3/1985
WO 03/101760 A1 12/2003

OTHER PUBLICATIONS

European Search Report dated Jul. 20, 2007.

* cited by examiner

*Primary Examiner*—David J Walczak
(74) *Attorney, Agent, or Firm*—Sughrue Mion, PLLC

(57) ABSTRACT

A direct-fluid-supply writing implement has a pentip, an ink occluding element connected to a rear end of the pentip, the ink occluding element including a high-density portion, and a low density portion continuously connected to a rear of the high density portion, an ink tank disposed at rear of the ink occluding element and adapted to directly store ink and pluralities of communicating tubes connecting the ink tank with the ink occluding element, the respective communicating tubes including an opened front end, wherein the front end of the communicating tube and the rear end of the pentip connect with the high-density portion.

43 Claims, 12 Drawing Sheets

DIRECT-FLUID-SUPPLY WRITING IMPLEMENT

The present invention claims foreign priority to Japanese patent application No. P.2004-267491, filed on Sep. 14, 2004, No. P.2005-026768, filed on Feb. 2, 2005 and No. P.2005-026769, filed on Feb. 2, 2005, the contents of which are incorporated herein by reference.

BACKGROUND OF THE INVENTION

1. Field of the Invention

The present invention relates to a direct-fluid-supply writing implement configured so that ink is stored directly in an ink tank and that an ink occluding element is interposed between the ink tank and a pentip. Incidentally, in the present specification, the word "front" designates a side toward the pentip, while the word "rear" designates a side toward the ink tank.

2. Description of the Background Art (1) Japanese Utility Model Examined Publication No. JP-UM-B-45-18890 discloses such a kind of a conventional direct-fluid-supply writing implement. The writing implement has an accommodating element having a communicating tube and a through hole and the accommodating element being filled with an absorbent material; an inkwell having an upper opening part in which the accommodating element inserted; a pentip inserted in the absorbent material; and a vent tube penetrating the through hole of the accommodating element; wherein an interior of the inkwell communicates with the absorbent material via the connecting tube, and an interior of inkwell communicates with ambient air via via the vent tube.

The direct-fluid-supply writing implement disclosed in the JP-UM-B-45-18890 is configured so that the vent tube always communicates with ambient air even though the communicating tube and the vent tube are provided in the upper opening part of the inkwell. Thus, in a case where a pentip downward-pointing state of this writing implement is maintained, ambient air is kept supplied into the inkwell through the vent tube. Simultaneously, ink contained in the inkwell is kept supplied to the absorbent material through the communicating tube. Consequently, there is a fear that the ink contained in the inkwell may leak out from a pentip.

(2) Further, Japanese Utility Model Examined Publication No. JP-UM-B-56-7504 discloses a felt-tip pen, which is one kind of direct-fluid-supply writing implement having a container body; an ink accommodating chamber having a ink supply port to which a sealing lid is detachably attached, the ink accommodating chamber provided a rear side of the container body; an ink absorbing member accommodating chamber having a first and second ink absorbing members provided on a front and rear side thereof, respectively; a pen tip of which base portion is held by the first absorbing member, a end surface of the base portion contacts with the second absorbing member; a partition wall separating the ink accommodating chamber from ink absorbing member accommodating chamber; and an air supply tube fixed to the partition wall, the air supply tube having a first opening abutting on the first absorbing member and a second opening provided in the ink accommodating chamber in a vicinity of the ink supply port, wherein an ink stored in the ink accommodating chamber is supplied to the absorbing member through a liquid supply hole provided on the partition wall.

The direct-fluid-supply writing implement disclosed in the JP-UM-B-56-7504 has the two absorbing members and is configured so that the first opening of the air supply tube is made to abut against the rear end surface of the first absorbing member, and that the liquid supply hole communicates with the rear end surface of the second absorbing member. That is, this direct-fluid-supply writing implement is configured so that the first opening of the air supply tube and a front end opening of the liquid supply hole are placed apart from each other in an anteroposterior direction. Thus, it is difficult to block up the opening end of the air supply tube with ink that is supplied from the liquid supply hole and is impregnated into the absorbing member (that is, to bring the opening end of the air supply tube into a liquid sealing state). The outflow of ink from the ink tank, and the inflow of air into the ink tank (that is, the exchange between the ink and the air) cannot surely be stopped. Consequently, there are fears that excessive ink may be supplied to the absorbing member, and that the ink may leak out from the pentip.

Additionally, the direct-fluid-supply writing implement disclosed in the JP-UM-B-56-7504 is configured so that the pentip penetrates through the first absorbing member and contacts the second absorbing member. Thus, it is difficult to set the longitudinal dimension of the pentip at a small value. Consequently, the cost of the pentip increases, so that this implement cannot be provided to a user at a low price. Also, the length of an ink outflow passage between the rear end and the front end of the pentip increases, so that the ability to cause outflow of ink from the pentip is degraded. Consequently, blur and discontinuity tend to occur in handwritten characters.

(3) Furthermore, Japanese Utility Model Examined Publication No. JP-UM-B-60-7191 discloses a brush-like writing implement, which is one kind of the direct-fluid-supply writing implement. The brush-like writing implement has an ink tank; a brush element; a front barrel having ink adjusting tube and an ink conduit which are coaxially disposed in the front barrel; a relay core inserted in the ink conduit, the relay core has a rear end inserted in the ink tank and a front end disposed on a rear end of the brush element with a predetermined interval; a porous ink absorbing member attached to both of the rear end of the brush element and a annular passage defined between the ink adjusting tube and the ink conduit; an air passage communicating with ambient air, formed between an inner surface of the front barrel and an outer surface of the ink adjusting tube; an ink passage formed on the rear end of the brush element and communicating with the air passage, wherein a density of the ink absorbing member at a front side is greater than that of the other part of the ink absorbing member.

The direct-fluid-supply writing implement disclosed in JP-UM-B-60-7191 is configured so that the ink tank is connected to the ink absorbing member only by the single ink conduit. Thus, at initial ink supply (that is, at the time of initially supplying ink from the ink tank to the absorbing member), air and ink cannot quickly be exchanged. It takes considerable time to bring the writing implement into a state in which the writing implement is ready for writing. Additionally, the direct-fluid-supply writing implement disclosed in the JP-UM-B-60-7191 has a large number of components and also has a complex structure. Consequently, this writing implement can be provided to a user at a low price.

SUMMARY OF THE INVENTION

The invention solves the problems of the conventional apparatuses, and aims at providing a direct-fluid-supply writing implement that is in no danger of leaking ink, which is stored in an ink tank, from a pentip side thereof, that enables quick exchange of air and ink at initial ink supply thereby to be made in a short time to be ready for writing, and that can be configured to have a simple structure.

According to a first aspect of the present invention, there is provided a direct-fluid-supply writing implement comprising:

a pentip;

an ink occluding element connected to a rear end of the pentip, the ink occluding element including:

a high-density portion; and a low density portion continuously connected to a rear of the high density portion;

an ink tank disposed at rear of the ink occluding element and adapted to directly store ink; and pluralities of communicating tubes connecting the ink tank with the ink occluding element, the respective communicating tubes including an opened front end, wherein the front end of the communicating tube and the rear end of the pentip connect with the high-density portion.

According to a second aspect of the present invention, as set forth in the first aspect of the present invention, it is preferable that each of the communicating tubes penetrates through an inside of the low density portion.

According to a third aspect of the present invention, as set forth in the first aspect of the present invention, it is preferable that when the front end of each of the communicating tubes is inserted into the ink occluding element from a rear end thereof, the front end of each of the communicating tubes frontwardly compresses an inside of the ink occluding element to thereby form the high density portion in the ink occluding element in vicinity of each of the front end of the communicating tubes.

According to a fourth aspect of the present invention, as set forth in the first aspect of the present invention, it is preferable that the high density portion is formed by radially and inwardly compressing an outer surface of the ink occluding element.

According to a fifth aspect of the present invention, as set forth in the first aspect of the present invention, it is preferable that the high density portion is formed by rearwardly compressing a front end surface of the ink occluding element.

According to a sixth aspect of the present invention, as set forth in the first aspect of the present invention, it is preferable that the ink occluding element includes:

a first ink occluding member, whose density is set at a high value; and a second ink occluding member, whose density is set at a low value, wherein the first occluding member constitutes the high density portion, while the second ink occluding member constitutes the low density portion.

According to a seventh aspect of the present invention, as set forth in the first aspect of the present invention, it is preferable that an ink absorbing element having a capillary gap is disposed in each of the communicating tubes, and capillary force of the ink absorbing element is set to be less than that of the high density portion.

According to an eighth aspect of the present invention, as set forth in the first aspect of the present invention, it is preferable that axial positions of the front ends of the communicating tubes are set to be same each other.

According to a ninth aspect of the present invention, as set forth in the first aspect of the present invention, it is preferable that the front end of each of the communicating tubes is placed in vicinity of the rear end of the pentip.

According to a tenth aspect of the present invention, as set forth in the first aspect of the present invention, it is preferable that the rear end of the pentip connects with the front end of each of the communicating tubes through the high density portion so that ink is flowable therebetween.

According to an eleventh aspect of the present invention, as set forth in the first aspect of the present invention, it is preferable that a front end surface and a rear end surface of the ink occluding element communicate with ambient air.

According to a twelfth aspect of the present invention, as set forth in the first aspect of the present invention, it is preferable that side walls of the communicating tubes are connected to one another.

According to a thirteenth aspect of the present invention, there is provided a direct-fluid-supply writing implement comprising:

a pentip;

an ink occluding element connected to a rear end of the pentip;

an ink tank disposed in a rear of the ink occluding element and adapted to directly store ink; and pluralities of communicating tubes connecting the ink tank with the ink occluding element, each of the communicating tubes including an opened front end;

wherein the front end of each of the communicating tubes is placed in the ink occluding element, and axial positions of the front ends of the communicating tubes are set to be same each other.

According to a fourteenth aspect of the present invention, there is provided a direct-fluid-supply writing implement comprising:

a pentip;

an ink occluding element connected to a rear end of the pentip;

an ink tank disposed in a rear of the ink occluding element and adapted to directly store ink; and pluralities of communicating tubes connecting the ink tank with the ink occluding element, each of the communicating tubes including an opened front end, wherein the front end of each of the communicating tubes is placed in vicinity of the rear end of the pentip in the ink occluding element.

According to a fifteenth aspect of the present invention, there is provided a direct-fluid-supply writing implement comprising:

a pentip;

an ink occluding element connected to a rear end of the pentip;

an ink tank disposed in a rear of the ink occluding element and adapted to directly store ink; and pluralities of communicating tubes connecting the ink tank with the ink occluding element, each of the communicating tubes including an opened front end, wherein the front end of each of the communicating tubes is placed in vicinity of the rear end of the pentip in the ink occluding element; and axial positions of the front ends of the communicating tubes are set to be same each other.

According to a sixteenth aspect of the present invention, there is provided a direct-fluid-supply writing implement comprising:

a pentip;

an ink occluding element connected to a rear end of the pentip;

an ink tank disposed in a rear of the ink occluding element and adapted to directly store ink; and pluralities of communicating tubes connecting the ink tank with the ink occluding element, each of the communicating tubes including an opened front end, wherein the front end of each of the communicating tubes is placed at an inner front portion of the ink occluding element and the rear end of the pentip is placed in the inner front portion of the ink occluding element.

According to a seventeenth aspect of the present invention, there is provided a direct-fluid-supply writing implement comprising:

a pentip;

an ink occluding element connected to a rear end of the pentip;

an ink tank disposed in a rear of the ink occluding element and adapted to directly store ink; and pluralities of communicating tubes connecting the ink tank with the ink occluding element, each of the communicating tubes including an opened front end;

wherein the front end of each of the communicating tubes is placed in the ink occluding element.

According to an eighteenth aspect of the present invention, as set forth in the thirteenth through seventeenth aspects of the present invention, it is preferable that the rear end of the pentip connects with the front end of each of the communicating tubes through the ink occluding element so that ink is flowable therebetween.

According to a nineteenth aspect of the present invention, as set forth in the thirteenth through seventeenth aspects of the present invention, it is preferable that the front end of each of the communicating tubes is frontwardly inserted into the ink occluding element from the rear end thereof, and frontwardly compresses an inside of the ink occluding element, so that a density of a first part of the ink occluding element in vicinity of the front end of each of the communicating tubes is set higher than a density of a second part of the ink occluding element, which is other than the first part of the ink occluding element.

According to a twentieth aspect of the present invention, as set forth in the nineteenth aspect of the present invention, it is preferable that the front end of each of the communicating tubes is formed into a pointed shape.

According to a twenty first aspect of the present invention, as set forth in the twentieth aspect of the present invention, it is preferable that the front end of each of the communicating tubes is constituted by an inclined cut surface that includes the front end opening portion thereof.

According to a twenty second aspect of the present invention, as set forth in the thirteenth through seventeenth aspects of the present invention, it is preferable that distances defined from the front end of the ink occluding element to each of the communicating tubes is set to be within a range from 3% to 50% of an axial length of the entire ink occluding element.

According to a twenty third aspect of the present invention, as set forth in the thirteenth through seventeenth aspects of the present invention, it is preferable that distances defined from the front end of the ink occluding element to each of the communicating tubes are set to be equal to one another.

According to a twenty fourth aspect of the present invention, as set forth in the thirteenth through seventeenth aspects of the present invention, it is preferable that distances defined from the rear end of the pentip to the front ends of the communicating tubes are set to be within 10 mm.

According to a twenty fifth aspect of the present invention, as set forth in the thirteenth through seventeenth aspects of the present invention, it is preferable that distances defined from the rear end of the pentip to the front ends of the communicating tubes are set to be equal to one another.

According to a twenty sixth aspect of the present invention, as set forth in the thirteenth through seventeenth aspects of the present invention, it is preferable that a front end surface and a rear end surface of the ink occluding element communicate with ambient air.

According to a twenty seventh aspect of the present invention, as set forth in the thirteenth through seventeenth aspects of the present invention, it is preferable that an ink absorbing element having a capillary gap is disposed in each of the communicating tubes.

According to a twenty eighth aspect of the present invention, as set forth in the thirteenth through seventeenth aspects of the present invention, it is preferable that side walls of the communicating tubes are connected to one another.

According to a twenty ninth aspect of the present invention, as set forth in the first aspect of the present invention, it is preferable that a void ratio of the low density portion is 70% or more and 90% or less, a gap between the void ratio of the low density portion and a void ratio of the high density portion is 7% or more.

According to a thirtieth aspect of the present invention, as set forth in the nineteenth aspect of the present invention, it is preferable that a void ratio of the second part of the ink occluding element is 70% or more and 95% or less, and a gap between the void ratio of the second part of the ink occluding element and a void ratio of the first part of the ink occluding element is 7% or more.

According to the first aspect of the invention, there is no fear that ink stored in the ink tank may leak out of the pentip. Also, at the initial ink supply, the exchange between air and ink is quickly performed. The writing implement quickly becomes ready for writing. Further, even in a state, such as a pentip upward-pointing state, and a writing-implement-body horizontal state, in which ink is not supplied to the pentip from the ink tank, ink impregnated in the ink occluding element is sufficient for enabling the writing implement to be ready for writing. Additionally, the configuration of the writing implement can be simplified.

According to the second aspect of the invention, there is no fear that ink stored in the ink tank may leak out of the pentip. Also, at the initial ink supply, the exchange between air and ink is quickly performed. The writing implement quickly becomes ready for writing. Further, even in a state, such as a pentip upward-pointing state, and a writing-implement-body horizontal state, in which ink is not supplied to the pentip from the ink tank, ink impregnated in the ink occluding element is sufficient for enabling the writing implement to be ready for writing. Also, the low density portion having sufficient capacity can be set without increasing the outside diameter of the portion accommodating the ink occluding element. Additionally, the configuration of the writing implement can be simplified.

According to the third aspect of the invention, there is no necessity for preliminarily generating a difference in density in the ink occluding element before the communicating tubes are incorporated into the ink occluding element. Consequently, the manufacture of the writing implement can extremely be facilitated.

According to the fourth aspect of the invention, there is provided the writing implement having no necessity for preliminarily generating a difference in density in the ink occluding element. Consequently, the manufacture of the writing implement can extremely be facilitated.

According to the fifth aspect of the invention, there is no necessity for preliminarily generating a difference in density in the ink occluding element. Consequently, the manufacture of the writing implement can extremely be facilitated.

According to the sixth aspect of the invention, the density difference can reliably be set in the ink occluding element without variation.

According to the seventh aspect of the invention, even in a case where the outside diameter and the inside diameter of each of the communicating tubes are set at relatively large values so as to suppress the communicating tubes, the front end opening portion of the communicating tube can appropriately be liquid-sealed.

According to the eighth aspect of the invention, the distances among the front ends of the communicating tubes in the ink occluding element can be further reduced. The liquid-sealability of the front opening portion of each of the communicating tubes can be enhanced. Leakage of ink to the outside can be further prevented.

According to the eighth aspect of the invention, ink can quickly be supplied to the pentip, regardless of which communicating tube supplies ink from the front end opening portion thereof. Consequently, at the initial ink supply, the writing implement can surely and quickly become ready for writing.

According to the tenth aspect of the invention, even in a state, such as a pentip upward-pointing state, and a writing-implement-body horizontal state, in which ink is not supplied to the pentip from the ink tank, it is sufficiently possible for the writing implement to write characters. There is no fear that excessive ink is supplied directly to the pentip and leaks out therefrom.

According to the eleventh aspect of the invention, ink supplied from the front end opening portion of the communicating tube in the ink occluding element can smoothly be moved from the vicinity of the front end of the communicating tube in the ink occluding element toward the front end of the ink occluding element and from the inside of the ink occluding element toward the rear end of the ink occluding element.

According to the twelfth aspect of the invention, the bending strength of each of the communicating tubes is enhanced. Each of the communicating tubes can be suppressed from being bent.

According to the thirteenth aspect of the invention, there is no fear that ink stored in the ink tank may leak out of the pentip. Also, at the initial ink supply, the exchange between air and ink is quickly performed. The writing implement quickly becomes ready for writing. Further, the configuration of the writing implement can be simplified.

According to the fourteenth aspect of the invention, there is no fear that ink stored in the ink tank may leak out of the pentip. Also, at the initial ink supply, the exchange between air and ink is quickly performed. Additionally, ink can be quickly supplied to the rear end of the pentip from the front end opening portion of any communicating tube. The writing implement quickly and reliably becomes ready for writing. Further, the configuration of the writing implement can be simplified.

According to the fifteenth aspect of the invention, there is no fear that ink stored in the ink tank may leak out of the pentip. Also, at the initial ink supply, the exchange between air and ink is quickly performed. Additionally, ink can be quickly supplied to the rear end of the pentip from the front end opening portion of any communicating tube. The writing implement quickly and reliably becomes ready for writing. Further, the configuration of the writing implement can be simplified.

According to the sixteenth aspect of the invention, there is no fear that ink stored in the ink tank may leak out of the pentip. Further, the longitudinal dimension of the pentip can be reduced to there by suppress the cost of the pentip. Moreover, the smooth flowability of ink from the pentip can be achieved. Also, at the initial ink supply, the exchange between air and ink is quickly performed. The writing implement quickly becomes ready for writing. Further, the configuration of the writing implement can be simplified.

According to the seventeenth aspect of the invention, there is no fear that ink stored in the ink tank may leak out of the pentip. Also, at the initial ink supply, the exchange between air and ink is quickly performed. The writing implement quickly becomes ready for writing. Further, the configuration of the writing implement can be simplified.

According to the eighteenth aspect of the invention, even in a state, such as a pentip upward-pointing state, and a writing-implement-body horizontal state, in which ink is not supplied to the pentip from the ink tank, ink impregnated in the ink occluding element sufficiently enables the writing implement to write characters.

According to the nineteenth aspect of the invention, the front end opening portion of each of the communicating tubes can surely be liquid-sealed by impregnated ink. Additionally, there is no necessity for preliminarily generating a difference in density in the ink occluding element before the communicating tubes are incorporated into the ink occluding element. Consequently, the manufacture of the writing implement can extremely be facilitated.

According to the twentieth aspect of the invention, each of the communicating tubes can be smoothly thrust-inserted into the ink occluding element from the rear end thereof. Consequently, the assembling process of the writing implement can be simplified.

According to the twenty first aspect of the invention, the ability to smoothly thrust-insert each of the communicating tubes is further enhanced. The area of the opening of the front end opening portion of each of the communicating tubes 6 increases. Consequently, ink can quickly be supplied into the ink occluding element.

According to the twenty second aspect of the invention, when the inner pressure of the ink tank rises, ink does not leak out of the front end of the ink occluding element. Additionally, sufficient flowability of ink from the pentip can be obtained to thereby prevent occurrence of discontinuity and blur in handwritten characters.

According to the twenty third aspect of the invention, the liquid-sealability of the front opening portion of each of the communicating tubes can be enhanced. Leakage of ink to the outside can be further prevented.

According to the twenty fourth aspect of the invention, at the initial ink supply, ink is quickly supplied from the front end of each of the communicating tubes to the rear end of the pentip. Thus, the writing implement quickly becomes ready for writing.

According to the twenty fifth aspect of the invention, at the initial ink supply, regardless of which communicating tube supplies ink to the rear end of the pentip from the front end opening portion thereof, in a constant time, the writing implement becomes ready for writing, without variation.

According to the twenty sixth aspect of the invention, ink supplied from the front end opening portion of the communicating tube in the ink occluding element can smoothly be moved from the vicinity of the front end of the communicating tube in the ink occluding element toward the front end of the ink occluding element and from the inside of the ink occluding element toward the rear end of the ink occluding element.

According to the twenty seventh aspect of the invention, even when the outside diameter and the inside diameter of each of the communicating tubes are set at relatively large values so as to prevent the communicating tubes from being bent, respectively, the front end opening portion of each of the communicating tubes can appropriately be liquid-sealed.

According to the twenty eighth aspect of the invention, the bending strength of each of the communicating tubes is enhanced. Each of the communicating tubes can be suppressed from being bent.

According to the twenty ninth aspect of the invention, the front end opening portion of each of the communicating tubes can surely be liquid-sealed by the impregnated ink.

According to the thirtieth aspect of the invention, the front end opening portion of each of the communicating tubes can surely be liquid-sealed by the impregnated ink.

DETAILED DESCRIPTION OF THE PREFERRED EMBODIMENTS

Figure 1:
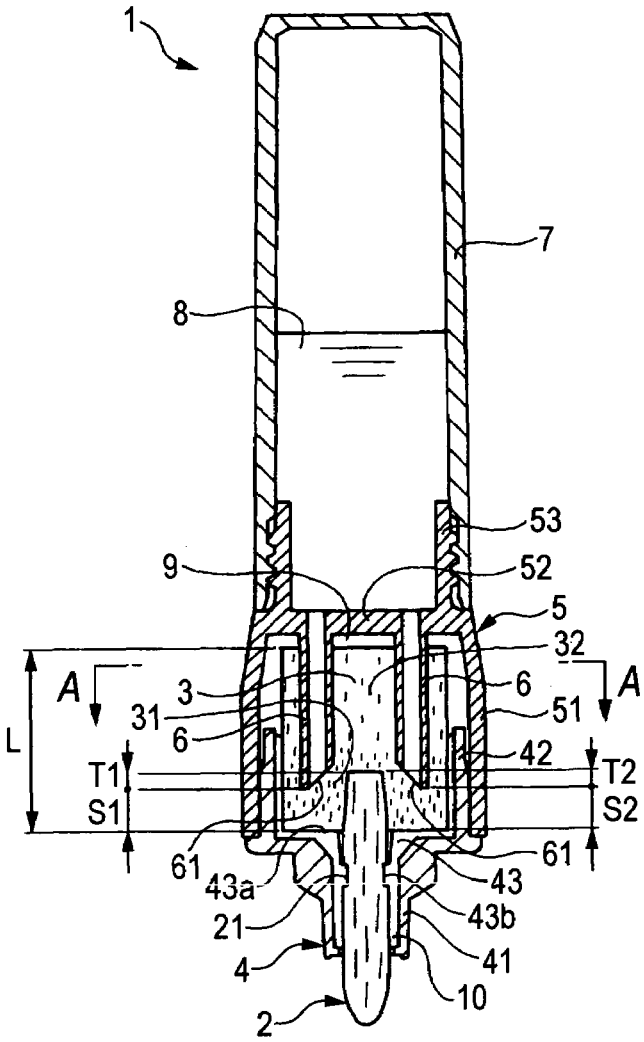
FIG. 1 is a longitudinally cross-sectional view illustrating a pentip downward-pointing state of-a first embodiment of the invention.

Hereinafter, best modes for carrying out the invention are described.

A direct-fluid-supply writing implement 1 according to a first mode of the invention includes a pentip 2, an ink occluding element 3 connected to the rear end of the pentip 2, an ink tank 7 that is disposed in the rear of the ink occluding element 3 and that directly stores ink 8, and a communicating tube 6 connecting between the ink tank 7 and the ink occluding element 3. Further, this writing implement 1 according to a first aspect of the invention requires that this implement 1 has a plurality of the communicating tubes 6, that the front end of each of the communicating tubes 6 is opened, that the ink occluding element 3 has a high-density portion 31 and a low density portion 32 continuously connected to the rear of the high density portion 31, and that the front end of each of the communicating tubes 6 is connected to the rear end of the pentip 2.

Each of the communicating tubes 6 of the direct-fluid-supply writing implement 1 according to a first aspect of the invention has the function of supplying ink 8, which is contained in the ink tank 7, into the ink occluding element 3 and the function of supplying ambient air into the ink tank 7. In a case where the pentip 2 is put into a downward-pointing state when the ink 8 contained in the ink tank 7 is supplied to the ink occluding element 3, the ink 8 contained in the ink tank 7 flows through at least one of the communicating tubes 6 due to the force of gravitation and is supplied to the high density portion 31 of the ink occluding element 3. The ink 8 is impregnated into the ink occluding element 3 in the high density portion 31. Simultaneously, ambient air is taken into the ink tank 7 through another communicating tube 6. That is, in a case where the writing implement has n communicating tubes 6 (n is an integer that is equal to or larger than 2), the communicating tubes 6, the number of which is equal to or more than 1 and is equal to or less than (n−1), supply ink. The remaining communicating tubes 6 supply ambient air.

When an amount of ink impregnated in the high density portion 31 of the ink occluding element 3 reaches a certain amount, the front end opening portion of another communicating tube 6 having taken ambient air into the tank is put into a liquid-sealed state and is temporarily closed. Thus, the supply of ambient air into the ink tank 7 is stopped. Simultaneously, the supply of ink to the ink occluding element 3 from the ink tank 7, which has been performed by the communicating tube 6, is stopped. Consequently, the front end opening portion of each of the communicating tubes 6 is brought into a liquid-sealed state and is temporarily closed. The outflow of ink from the ink tank 7 and the inflow of air into the ink tank (that is, the exchange between ink and air) are put into a halting state.

The direct-fluid-supply writing implement 1 according to the first aspect of the invention is configured so that the ink occluding element 3 has a portion (that is, the high density portion 31), which is provided at a position in the vicinity of the front end of each of the communicating tubes 6 and is set to have a high density, and a portion (that is, the low density portion 31), which is provided at places other than the position in the vicinity of the front end of each of the communicating tubes 6 and is set to have a low density. Thus, ink contained in the ink occluding element 3 can be impregnated in the high density portion 31 in preference to the low density portion 32. Consequently, the front end opening portion of each of the communicating tubes 6 can surely be liquid-sealed by the impregnated ink. Thus, when the internal pressure of the ink tank 7 is reduced due to temperature drop or the like, the ink impregnated in the ink occluding element 3 is not residual in the ink occluding element 3. The ink is properly returned to the ink tank 7 from the high density portion 31 of the ink occluding element 3 through the communicating tube 6.

The direct-fluid-supply writing implement 1 according to the first aspect of the invention is configured so that the front end of each of the communicating tubes 6 is connected to the high density portion 31 of the ink occluding element 3. Thus, all the front end opening portions of the communicating tubes 6 can easily be closed by the liquid-seal due to the ink impregnated in the ink occluding element 3. Consequently, excessive ink is not supplied from the ink tank 7 to the ink occluding element 3. There is no fear that ink leaks out from the pentip 2.

The direct-fluid-supply writing implement 1 according to the first aspect of the invention has a plurality of communicating tubes 6 (that is, two or more communicating tubes 6. Thus, in a case where at least one communicating tube 6 supplies ink, another communicating tube 6 supplies air. Consequently, at initial ink supply (that is, at the time of initially supplying ink to the ink occluding element 3 in which no ink is impregnated), air and ink can quickly be exchanged. Consequently, in a short time, the writing implement becomes ready for writing.

The direct-fluid-supply writing implement 1 according to the first aspect of the invention is configured so that the rear end of the pentip 2 is connected to the high density portion 31. Thus, even in a state, such as a pentip upward-pointing state, and a writing-implement-body horizontal state, in which ink is not supplied to the pentip 2 from the ink tank, it is sufficiently possible for the writing implement to write characters.

A direct-fluid-supply writing implement 1 according to a second mode of the invention includes a pentip 2, an ink occluding element 3 connected to the rear end of the pentip 2, an ink tank 7 that is disposed in the rear of the ink occluding element 3 and that directly stores ink 8, and a communicating tube 6 connecting between the ink tank 7 and the ink occluding element 3. Further, this writing implement 1 according to the second aspect of the invention according to the second aspect of the invention requires that this implement 1 has a plurality of the communicating tubes 6, that the front end of each of the communicating tubes 6 is opened, that the ink occluding element 3 has a high-density portion 31 and a low density portion 32 continuously connected to the rear of the high density portion 31, that each of the communicating tubes 6 penetrates through the inside of the low density portion 32, and that the front end of each of the communicating tubes 6 and the rear end of the pentip 2 are connected to the high density portion 31.

Each of the communicating tubes 6 of the direct-fluid-supply writing implement 1 according to the second aspect of the invention has the function of supplying ink 8, which is contained in the ink tank 7, into the ink occluding element 3 and the function of supplying ambient air into the ink tank 7. In a case where the pentip 2 is put into a downward-pointing state when the ink 8 contained in the ink tank 7 is supplied to the ink occluding element 3, the ink 8 contained in the ink tank 7 flows through at least one of the communicating tubes 6 due to the force of gravitation and is supplied to the high density portion 31 of the ink occluding element 3. The ink 8 is impregnated into the ink occluding element 3 in the high density portion 31. Simultaneously, ambient air is taken into the ink tank 7 through another communicating tube 6. That is, in a case where the writing implement has n communicating tubes 6 (n is an integer that is equal to or larger than 2), the communicating tubes 6, the number of which is equal to or more than 1 and is equal to or less than (n−1), supply ink. The remaining communicating tubes 6 supply ambient air.

When an amount of ink impregnated in the high-density portion 31 of the ink occluding element 3 reaches a certain amount, the front end opening portion of another communicating tube 6 having taken ambient air into the tank is put into a liquid-sealed state and is temporarily closed. Thus, the supply of ambient air into the ink tank 7 is stopped. Simultaneously, the supply of ink to the ink occluding element 3 from the ink tank 7, which has been performed by the communicating tube 6, is stopped. Consequently, the front end opening portion of each of the communicating tubes 6 is brought into a liquid-sealed state and is temporarily closed. The outflow of ink from the ink tank 7 and the inflow of air into the ink tank (that is, the exchange between ink and air) are put into a halting state.

The direct-fluid-supply writing implement 1 according to the second aspect of the invention is configured so that the ink occluding element 3 has a portion (that is, the high density portion 31), which is provided at a position in the vicinity of the front end of each of the communicating tubes 6 and is set to have a high density, and a portion (that is, the low density portion 31), which is provided at places other than the position in the vicinity of the front end of each of the communicating tubes 6 and is set to have a low density. Thus, ink contained in the ink occluding element 3 can be impregnated in the high density portion 31 in preference to the low density portion 32. Consequently, the front end opening portion of each of the communicating tubes 6 can surely be liquid-sealed by the impregnated ink. Thus, when the internal pressure of the ink tank 7 is reduced due to temperature drop or the like, the ink impregnated in the ink occluding element 3 is not residual in the ink occluding element 3. The ink is properly returned to the ink tank 7 from the high density portion 31 of the ink occluding element 3 through the communicating tube 6.

The direct-fluid-supply writing implement 1 according to the second aspect of the invention is configured so that the front end of each of the communicating tubes 6 is connected to the high density portion 31 of the ink occluding element 3. Thus, all the front end opening portions of the communicating tubes 6 can easily be closed by the liquid-seal due to the ink impregnated in the ink occluding element 3. Consequently, excessive ink is not supplied from the ink tank 7 to the ink occluding element 3. There is no fear that ink leaks out from the pentip 2.

The direct-fluid-supply writing implement 1 according to the second aspect of the invention has a plurality of communicating tubes 6 (that is, two or more communicating tubes 6. Thus, in a case where at least one communicating tube 6 supplies ink, another communicating tube 6 supplies air. Consequently, at initial ink supply (that is, at the time of initially supplying ink to the ink occluding element 3 in which no ink is impregnated), air and ink can quickly be exchanged. Consequently, in a short time, the writing implement becomes ready for writing.

The direct-fluid-supply writing implement 1 according to the second aspect of the invention is configured so that the rear end of the pentip 2 is connected to the high density portion 31. Thus, even in a state, such as a pentip upward-pointing state, and a writing-implement-body horizontal state, in which ink is not supplied to the pentip 2 from the ink tank, it is sufficiently possible for the writing implement to write characters.

The direct-fluid-supply writing implement 1 according to the second aspect of the invention is configured so that each of the communicating tubes 6 penetrates through the inside of the low density portion 32. Thus, the low density portion 32 having sufficient capacity can be set without increasing the outside diameter of the portion accommodating the ink occluding element 3. In a case where each of the communicating tubes 6 is connected to the high density portion 31 without penetrating through the inside of the low density portion 32, there is a fear that the outside diameter of the portion accommodating the ink occluding element 3 is increased, and that it is difficult to grip the body of the writing implement. Alternatively, there is a fear that the capacity of the low density portion 32 decreases and cannot fully absorb excessive ink supplied from the ink tank 7.

Preferably, according to an embodiment as set forth in the third aspect of the invention of the direct-fluid-supply writing implement 1 according to the first or second aspect of the invention, when the front end of each of the communicating tubes 6 is inserted into the ink occluding element 3 from the rear end thereof, the front end of each of the communicating tubes 6 frontwardly compresses the inside of the ink occluding element 3 to thereby form the high density portion 31 in the ink occluding element 3 and in the vicinity of the front end of each of the communicating tubes 6.

The direct-fluid-supply writing implement 1 according to the third aspect of the invention is adapted so that portions differing in density (that is, the high density portion 31 and the low density portion 32 of the ink occluding element 3) are formed in the ink occluding element 3 by frontwardly inserting the front end of each of the communicating tubes 6 into the ink occluding element 3 from the rear end thereof and by frontwardly compressing the inside of the ink occluding element 3. Thus, there is no necessity for preliminarily generating a difference in density in the ink occluding element 3 before the communicating tubes 6 are incorporated into the ink occluding element 3. Consequently, the manufacture of the writing implement can extremely be facilitated. Also, occurrences of failure of the connection between the high density portion 31 and the front end of each of the communicating tubes 6 can be suppressed.

Preferably, according to an embodiment as set forth in the fourth aspect of the invention, of the direct-fluid-supply writing implement 1 according to the first through third aspect of the invention, the high density portion 31 is formed by radially and inwardly compressing the outer surface of the ink occluding element 3. Thus, there is no necessity for preliminarily generating a difference in density in the ink occluding element 3. Consequently, the manufacture of the writing implement can extremely be facilitated.

Preferably, according to an embodiment as set forth in the fifth aspect of the invention of the direct-fluid-supply writing implement 1 according to the first through fourth aspect of the invention, the high density portion 31 is formed by rearwardly compressing the front end surface of the ink occluding element 3. Thus, there is no necessity for preliminarily generating a difference in density in the ink occluding element 3. Consequently, the manufacture of the writing implement can extremely be facilitated.

Preferably, according to an embodiment as set forth in the sixth aspect of the invention of the direct-fluid-supply writing implement 1 according to the first or second aspect of the invention, the ink occluding element 3 includes a first ink occluding member, whose density is set at a high value, and a second ink occluding member, whose density is set at a low value. The first occluding member constitutes the high density portion 31, while the second ink occluding member constitutes the low density portion 32. Consequently, each of the high density portion 31 and the low density portion 32 can reliably be set in the ink occluding element 3 (that is, the density difference can reliably be generated in the ink occluding element 3) without variation.

Preferably, according to an embodiment as set forth in the seventh aspect of the invention of the direct-fluid-supply writing implement 1 according to the first through sixth aspect of the invention, an ink absorbing element 63 having a capillary gap is disposed in each of the communicating tubes 6. The capillary force of the ink absorbing element 63 is set to be less than that of the high density portion 31.

According to the direct-fluid-supply writing implement 1 as set forth the seventh aspect of the invention, even when the outside diameter and the inside diameter of each of the communicating tubes 6 are set at relatively large values so as to prevent the communicating tubes 6 from being bent, respectively, the front end opening portion of each of the communicating tubes 6 can appropriately be liquid-sealed.

Preferably, according to an embodiment as set forth in the eighth aspect of the invention of the direct-fluid-supply writing implement 1 according to the first to seventh aspect of the invention), the axial positions of the front ends of the communicating tubes 6 are set to be same each other.

The direct-fluid-supply writing implement 1 according to the eighth aspect of the invention is configured so that the axial positions of the front ends of the communicating tubes 6 are set to be same (that is, the front ends of the communicating tubes 6 are not displaced from one another in an antero-posterior direction). Thus, the distances among the front ends of the communicating tubes 6 in the ink occluding element 3 can be further reduced. The liquid-sealability of the front opening portion of each of the communicating tubes 6 can be enhanced. Leakage of ink to the outside can be further prevented.

Preferably, according to an embodiment as set forth in the ninth aspect of the invention of the direct-fluid-supply writing implement 1 according to the first to eighth aspect of the invention, the front end of each of the communicating tubes 6 is placed in the vicinity of the rear end of the pentip 2.

The direct-fluid-supply writing implement 1 according to the ninth aspect of the invention is configured so that the front end of each of the communicating tubes 6 is placed in the vicinity of the rear end of the pentip 2. Thus, regardless of which communicating tube 6 supplies ink from the front end opening portion thereof, ink can quickly be supplied to the pentip 2. Consequently, at the initial ink supply, the writing implement can surely and quickly become ready for writing.

Preferably, according to an embodiment according to the tenth aspect of the invention of the direct-fluid-supply writing implement 1 according to the first to ninth aspect of the invention, the rear end of the pentip 2 is connected through the high density portion 31 to the front end of each of the communicating tubes 6 so that ink is flowable therebetween.

According to the direct-fluid-supply writing implement 1 as set forth in the tenth aspect of the invention is configured so that the rear end of the pentip 2 is not directly connected to the front end of each of the communicating tubes 6. Thus, a certain amount of ink is impregnated at least in the ink occluding element 3 between the rear end of the pentip 2 and the front end of each of the communicating tubes 6. Consequently, even in a state, such as a pentip upward-pointing state, and a writing-implement-body horizontal state, in which ink is not supplied to the pentip 2 from the ink tank, it is sufficiently possible for the writing implement to write characters. There is no fear that excessive ink is supplied directly to the pentip 2 and leaks out therefrom.

Preferably, according to an embodiment as set forth in the eleventh aspect of the invention of the direct-fluid-supply writing implement 1 according to the first to tenth aspect of the invention, the front end surface and the rear end surface of the ink occluding element 3 communicate with ambient air.

According to the direct-fluid-supply writing implement 1 according to the eleventh aspect of the invention, air contained in the ink occluding element 3 can be let out from the front end surface and the rear end surface of the ink occluding element 3. Consequently, ink supplied from the front end opening portion of the communicating tube 6 in the ink occluding element 3 can smoothly be moved from the vicinity of the front end of the communicating tube 6 in the ink occluding element 3 toward the front end of the ink occluding element 3 and from the inside of the ink occluding element 3 toward the rear end of the ink occluding element 3. Especially, when the rear end surface of the ink occluding element 3 communicates with ambient air to thereby increase the inner pressure of the ink tank 7 due to the rise of temperature or the like, ink pushed out of the ink tank 7 is smoothly and rearwardly moved from the front end of the communicating tube 6 through the vicinity of the front end of the communicating tube 6 in the ink occluding element 3. Then, the moved ink is impregnated in the rear portion of the ink occluding element 3. Thus, the ink is prevented from leaking out therefrom. Meanwhile, when the inner pressure of the ink tank 7 is reduced due to the drop of temperature or the like, the ink impregnated in the ink occluding element 3 can be returned to the inside of the ink tank 7 from the front end opening portion of the communicating tube 6 through the vicinity of the front end of the communicating tube 6 in the ink occluding element 3 and through the communicating tube 6.

Preferably, according to an embodiment as set forth in the twelfth aspect of the invention of the direct-fluid-supply writing implement 1 as set forth in the first to eleventh aspect of the invention, the side walls of the communicating tubes 6 are connected to one another. Consequently, the bending strength of each of the communicating tubes 6 is enhanced. Each of the communicating tubes 6 can be suppressed from being bent.

A direct-fluid-supply writing implement 1 according to a third mode of the invention includes a pentip 2, an ink occluding element 3 connected to the rear end of the pentip 2, an ink tank 7 that is disposed in the rear of the ink occluding element 3 and that directly stores ink 8, and a communicating tube 6 connecting between the ink tank 7 and the ink occluding element 3. Further, this writing implement 1 according to the thirteenth aspect of the invention requires that this implement 1 has a plurality of the communicating tubes 6, that the front end of each of the communicating tubes 6 is opened, that the front end of each of the communicating tubes 6 is placed in the ink occluding element 3, and that the axial positions of the front ends of the communicating tubes 6 are set to be same.

Each of the communicating tubes 6 of the direct-fluid-supply writing implement 1 according to the thirteenth aspect of the invention has the function of supplying ink 8, which is contained in the ink tank 7, into the ink occluding element 3 and the function of supplying ambient air into the ink tank 7. In a case where the pentip 2 is put into a downward-pointing state when the ink 8 contained in the ink tank 7 is supplied to the ink occluding element 3, the ink 8 contained in the ink tank 7 flows through at least one of the communicating tubes 6 due to the force of gravitation and is supplied to the high density portion 31 of the ink occluding element 3. The ink 8 is impregnated into the ink occluding element 3 in the high density portion 31. Simultaneously, ambient air is taken into the ink tank 7 through another communicating tube 6. That is, in a case where the writing implement has n communicating tubes 6 (n is an integer that is equal to or larger than 2), the communicating tubes 6, the number of which is equal to or more than 1 and is equal to or less than (n−1), supply ink. The remaining communicating tubes 6 supply ambient air.

When an amount of ink impregnated in the high density portion 31 of the ink occluding element 3 reaches a certain amount, the front end opening portion of another communicating tube 6 having taken ambient air into the tank is put into a liquid-sealed state and is temporarily closed. Thus, the supply of ambient air into the ink tank 7 is stopped. Simultaneously, the supply of ink to the ink occluding element 3 from the ink tank 7, which has been performed by the communicating tube 6, is stopped. Consequently, the front end opening portion of each of the communicating tubes 6 is brought into a liquid-sealed state and is temporarily closed. The outflow of ink from the ink tank 7 and the inflow of air into the ink tank (that is, the exchange between ink and air) are put into a halting state.

The direct-fluid-supply writing implement 1 according to the thirteenth aspect of the invention is configured so that the front end of each of the communicating tubes 6 is connected to the high density portion 31 of the ink occluding element 3. Thus, all the front end opening portions of the communicating tubes 6 can easily be closed by the liquid-seal due to the ink impregnated in the ink occluding element 3. Consequently, excessive ink is not supplied from the ink tank 7 to the ink occluding element 3. There is no fear that ink leaks out from the pentip 2.

The direct-fluid-supply writing implement 1 according to the thirteenth aspect of the invention is configured so that the axial positions of the front ends of the communicating tubes 6 are set to be same (that is, the front ends of the communicating tubes 6 are not displaced from one another in an antero-posterior direction). Thus, the distance among the front ends of the communicating tubes 6 in the ink occluding element 3 can be further reduced. The liquid-sealability of the front opening portion of each of the communicating tubes 6 can be enhanced. Leakage of ink to the outside can be further prevented.

The direct-fluid-supply writing implement 1 according to the thirteenth aspect of the invention has a plurality of communicating tubes 6 (that is, two or more communicating tubes 6. Thus, in a case where at least one communicating tube 6 supplies ink, another communicating tube 6 supplies air. Consequently, at initial ink supply (that is, at the time of initially supplying ink to the ink occluding element 3 in which no ink is impregnated), air and ink can quickly be exchanged. Consequently, in a short time, the writing implement becomes ready for writing.

A direct-fluid-supply writing implement 1 according to a fourth mode of the invention includes a pentip 2, an ink occluding element 3 connected to the rear end of the pentip 2, an ink tank 7 that is disposed in the rear of the ink occluding element 3 and that directly stores ink 8, and a communicating tube 6 connecting between the ink tank 7 and the ink occluding element 3. Further, this writing implement 1 according to the fourteenth aspect of the invention requires that this implement 1 has a plurality of the communicating tubes 6, that the front end of each of the communicating tubes 6 is opened, and that the front end of each of the communicating tubes 6 is placed in the vicinity of the rear end of the pentip 2 in the ink occluding element 3.

Each of the communicating tubes 6 of the direct-fluid-supply writing implement 1 according to the fourteenth aspect of the invention has the function of supplying ink 8, which is contained in the ink tank 7, into the ink occluding element 3 and the function of supplying ambient air into the ink tank 7. In a case where the pentip 2 is put into a downward-pointing state when the ink 8 contained in the ink tank 7 is supplied to the ink occluding element 3, the ink 8 contained in the ink tank 7 flows through at least one of the communicating tubes 6 due to the force of gravitation and is supplied to the high density portion 31 of the ink occluding element 3. The ink 8 is impregnated into the ink occluding element 3 in the high density portion 31. Simultaneously, ambient air is taken into the ink tank 7 through another communicating tube 6. That is, in a case where the writing implement has n communicating tubes 6 (n is an integer that is equal to or larger than 2), the communicating tubes 6, the number of which is equal to or more than 1 and is equal to or less than (n−1), supply ink. The remaining communicating tubes 6 supply ambient air.

When an amount of ink impregnated in the high density portion 31 of the ink occluding element 3 reaches a certain amount, the front end opening portion of another communicating tube 6 having taken ambient air into the tank is put into a liquid-sealed state and is temporarily closed. Thus, the supply of ambient air into the ink tank 7 is stopped. Simultaneously, the supply of ink to the ink occluding element 3 from the ink tank 7, which has been performed by the communicating tube 6, is stopped. Consequently, the front end opening portion of each of the communicating tubes 6 is brought into a liquid-sealed state and is temporarily closed. The outflow of ink from the ink tank 7 and the inflow of air into the ink tank (that is, the exchange between ink and air) are put into a halting state.

The direct-fluid-supply writing implement 1 according to the fourteenth aspect of the invention is configured so that the front end of each of the communicating tubes 6 is connected to the high density portion 31 of the ink occluding element 3. Thus, all the front end opening portions of the communicating tubes 6 can easily be closed by the liquid-seal due to the ink impregnated in the ink occluding element 3. Consequently, excessive ink is not supplied from the ink tank 7 to the ink occluding element 3. There is no fear that ink leaks out from the pentip 2.

The direct-fluid-supply writing implement 1 according to the fourteenth aspect of the invention has a plurality of communicating tubes 6 (that is, two or more communicating tubes 6). Thus, in a case where at least one communicating tube 6 supplies ink, another communicating tube 6 supplies air. Consequently, at initial ink supply (that is, at the time of initially supplying ink to the ink occluding element 3 in which no ink is impregnated), air and ink can quickly be exchanged. Consequently, in a short time, the writing implement becomes ready for writing.

The direct-fluid-supply writing implement 1 according to the fourteenth aspect of the invention is configured so that the front end of each of the communicating tubes 6 is placed in the vicinity of the rear end of the pentip 2. Thus, regardless of which communicating tube 6 supplies ink from the front end opening portion thereof, ink can quickly be supplied to the pentip 2. Consequently, at the initial ink supply, the writing implement can surely and quickly become ready for writing.

A direct-fluid-supply writing implement 1 according to a fifth mode of the invention includes a pentip 2, an ink occluding element 3 connected to the rear end of the pentip 2, an ink tank 7 that is disposed in the rear of the ink occluding element 3 and that directly stores ink 8, and a communicating tube 6 connecting between the ink tank 7 and the ink occluding element 3. Further, this writing implement 1 according to the fifteenth aspect of the invention requires that this implement 1 has a plurality of the communicating tubes 6, that the front end of each of the communicating tubes 6 is opened, that the front end of each of the communicating tubes 6 is placed in the vicinity of the rear end of the pentip 2 in the ink occluding element 3, and that the axial positions of the front ends of the communicating tubes 6 are set to be same.

Each of the communicating tubes 6 of the direct-fluid-supply writing implement 1 according to the fifteenth aspect of the invention has the function of supplying ink 8, which is contained in the ink tank 7, into the ink occluding element 3 and the function of supplying ambient air into the ink tank 7. In a case where the pentip 2 is put into a downward-pointing state when the ink 8 contained in the ink tank 7 is supplied to the ink occluding element 3, the ink 8 contained in the ink tank 7 flows through at least one of the communicating tubes 6 due to the force of gravitation and is supplied to the high density portion 31 of the ink occluding element 3. The ink 8 is impregnated into the ink occluding element 3 in the high density portion 31. Simultaneously, ambient air is taken into the ink tank 7 through another communicating tube 6. That is, in a case where the writing implement has n communicating tubes 6 (n is an integer that is equal to or larger than 2), the communicating tubes 6, the number of which is equal to or more than 1 and is equal to or less than (n−1), supply ink. The remaining communicating tubes 6 supply ambient air.

When an amount of ink impregnated in the high density portion 31 of the ink occluding element 3 reaches a certain amount, the front end opening portion of another communicating tube 6 having taken ambient air into the tank is put into a liquid-sealed state and is temporarily closed. Thus, the supply of ambient air into the ink tank 7 is stopped. Simultaneously, the supply of ink to the ink occluding element 3 from the ink tank 7, which has been performed by the communicating tube 6, is stopped. Consequently, the front end opening portion of each of the communicating tubes 6 is brought into a liquid-sealed state and is temporarily closed. The outflow of ink from the ink tank 7 and the inflow of air into the ink tank (that is, the exchange between ink and air) are put into a halting state.

The direct-fluid-supply writing implement 1 according to the fifteenth aspect of the invention is configured so that the front end of each of the communicating tubes 6 is connected to the high density portion 31 of the ink occluding element 3. Thus, all the front end opening portions of the communicating tubes 6 can easily be closed by the liquid-seal due to the ink impregnated in the ink occluding element 3. Consequently, excessive ink is not supplied from the ink tank 7 to the ink occluding element 3. There is no fear that ink leaks out from the pentip 2.

The direct-fluid-supply writing implement 1 according to the fifteenth aspect of the invention is configured so that the axial positions of the front ends of the communicating tubes 6 are set to be same (that is, the front ends of the communicating tubes 6 are not displaced from one another in an antero-posterior direction). Thus, the distance among the front ends of the communicating tubes 6 in the ink occluding element 3 can be further reduced. The liquid-sealability of the front opening portion of each of the communicating tubes 6 can be enhanced. Leakage of ink to the outside can be further prevented.

The direct-fluid-supply writing implement 1 according to the fifteenth aspect of the invention has a plurality of communicating tubes 6 (that is, two or more communicating tubes 6). Thus, in a case where at least one communicating tube 6 supplies ink, another communicating tube 6 supplies air. Consequently, at initial ink supply (that is, at the time of initially supplying ink to the ink occluding element 3 in which no ink is impregnated), air and ink can quickly be exchanged. Consequently, in a short time, the writing implement becomes ready for writing.

The direct-fluid-supply writing implement 1 according to the fifteenth aspect of the invention is configured so that the front end of each of the communicating tubes 6 is placed in the vicinity of the rear end of the pentip 2. Thus, regardless of which communicating tube 6 supplies ink from the front end opening portion thereof, ink can quickly be supplied to the pentip 2. Consequently, at the initial ink supply, the writing implement can surely and quickly become ready for writing.

A direct-fluid-supply writing implement 1 according to a sixth mode of the invention includes a pentip 2, an ink occluding element 3 connected to the rear end of the pentip 2, an ink tank 7 that is disposed in the rear of the ink occluding element 3 and that directly stores ink 8, and a communicating tube 6 connecting between the ink tank 7 and the ink occluding element 3. Further, this writing implement 1 according to the sixteenth aspect of the invention requires that this implement 1 has a plurality of the communicating tubes 6, that the front end of each of the communicating tubes 6 is opened, that the front end of each of the communicating tubes 6 is placed at an inner front portion of the ink occluding element 3, and that the rear end of the pentip is placed in the inner front portion of the ink occluding element 3.

Each of the communicating tubes 6 of the direct-fluid-supply writing implement 1 according to the sixteenth aspect of the invention has the function of supplying ink 8, which is contained in the ink tank 7, into the ink occluding element 3 and the function of supplying ambient air into the ink tank 7. In a case where the pentip 2 is put into a downward-pointing state when the ink 8 contained in the ink tank 7 is supplied to the ink occluding element 3, the ink 8 contained in the ink tank 7 flows through at least one of the communicating tubes 6 due to the force of gravitation and is supplied to the high density portion 31 of the ink occluding element 3. The ink 8 is impregnated into the ink occluding element 3 in the high density portion 31. Simultaneously, ambient air is taken into the ink tank 7 through another communicating tube 6. That is, in a case where the writing implement has n communicating tubes 6 (n is an integer that is equal to or larger than 2), the communicating tubes 6, the number of which is equal to or more than 1 and is equal to or less than (n−1), supply ink. The remaining communicating tubes 6 supply ambient air.

When an amount of ink impregnated in the high density portion 31 of the ink occluding element 3 reaches a certain amount, the front end opening portion of another communicating tube 6 having taken ambient air into the tank is put into a liquid-sealed state and is temporarily closed. Thus, the supply of ambient air into the ink tank 7 is stopped. Simultaneously, the supply of ink to the ink occluding element 3 from the ink tank 7, which has been performed by the communicating tube 6, is stopped. Consequently, the front end opening portion of each of the communicating tubes 6 is brought into a liquid-sealed state and is temporarily closed. The outflow of ink from the ink tank 7 and the inflow of air into the ink tank (that is, the exchange between ink and air) are put into a halting state.

The direct-fluid-supply writing implement 1 according to the sixteenth aspect of the invention is configured so that the front end of each of the communicating tubes 6 is connected to the high density portion 31 of the ink occluding element 3. Thus, all the front end opening portions of the communicating tubes 6 can easily be closed by the liquid-seal due to the ink impregnated in the ink occluding element 3. Consequently, excessive ink is not supplied from the ink tank 7 to the ink occluding element 3. There is no fear that ink leaks out from the pentip 2.

The direct-fluid-supply writing implement 1 according to the sixteenth aspect of the invention is configured so that the rear end of the pentip 2 is placed at the inner front portion of the ink occluding element 3. Thus, the longitudinal dimension of the entire pentip 2 can be set to be short. Consequently, ample ink from the ink tank 7 is supplied to the rear end of the pentip 2 through the communicating tube 6 and through the inner front portion of the ink occluding element 3. Then, the ink is quickly supplied to the front end of the pen point 2. Thus, the smooth flowability of ink from the pentip 2 can be obtained to thereby prevent occurrence of discontinuity and blur in handwritten characters. Also, because the longitudinal dimension of the entire pentip 2 can be set to be short, the cost of the pentip 2 can be suppressed.

The direct-fluid-supply writing implement 1 according to the sixteenth aspect of the invention has a plurality of communicating tubes 6 (that is, two or more communicating tubes 6. Thus, in a case where at least one communicating tube 6 supplies ink, another communicating tube 6 supplies air. Consequently, at initial ink supply (that is, at the time of initially supplying ink to the ink occluding element 3 in which no ink is impregnated), air and ink can quickly be exchanged. Consequently, in a short time, the writing implement becomes ready for writing.

According to the direct-fluid-supply writing implement 1 as set forth in the sixteenth aspect of the invention, when the rear end surface of the ink occluding element 3 communicates with ambient air to thereby increase the inner pressure of the ink tank 7 due to the rise of temperature or the like, excessive ink pushed out of the ink tank 7 is supplied to the inner front portion of the ink occluding element 3 through the communicating tube 6, and is also supplied to the inner rear portion of the ink occluding element 3. Thus, the ink is temporarily impregnated therein. Meanwhile, when the inner pressure of the ink tank 7 is reduced due to the drop of temperature or the like, the ink impregnated in the inner rear portion of the ink occluding element 3 can be returned to the inside of the ink tank 7 through the inner front portion of the ink occluding element 3 and through the communicating tube 6.

That is, the direct-fluid-supply writing implement 1 is configured so that the front end of each of the communicating tubes 6 is placed at the inner front portion of the ink occluding element 3. Thus, when the inner pressure of the ink tank 7 changes, excessive ink in the ink tank 7 can appropriately and temporarily be absorbed by the ink occluding element 3. Thereafter, the excessive ink can appropriately be returned to the ink tank 7. Consequently, ink can fully be prevented from leaking to the outside.

A direct-fluid-supply writing implement 1 according to a seventh mode of the invention includes a pentip 2, an ink occluding element 3 connected to a rear end of the pentip 2, an ink tank 7 that is disposed in a rear of the ink occluding element 3 and that directly stores ink 8, and a communicating tube 6 connecting between the ink tank 7 and the ink occluding element 3. Further, this writing implement 1 according to the seventeenth aspect of the invention requires that this implement 1 has a plurality of the communicating tubes 6, that the front end of each of the communicating tubes 6 is opened, that the front end of each of the communicating tubes 6 is placed in the ink occluding element 3.

Each of the communicating tubes 6 of the direct-fluid-supply writing implement 1 according to the seventeenth aspect of the invention has the function of supplying ink 8, which is contained in the ink tank 7, into the ink occluding element 3 and the function of supplying ambient air into the ink tank 7. In a case where the pentip 2 is put into a downward-pointing state when the ink 8 contained in the ink tank 7 is supplied to the ink occluding element 3, the ink 8 contained in the ink tank 7 flows through at least one of the communicating tubes 6 due to the force of gravitation and is supplied to the high density portion 31 of the ink occluding element 3. The ink 8 is impregnated into the ink occluding element 3 in the high density portion 31. Simultaneously, ambient air is taken into the ink tank 7 through another communicating tube 6. That is, in a case where the writing implement has n communicating tubes 6 (n is an integer that is equal to or larger than 2), the communicating tubes 6, the number of which is equal to or more than 1 and is equal to or less than (n−1), supply ink. The remaining communicating tubes 6 supply ambient air.

When an amount of ink impregnated in the high density portion 31 of the ink occluding element 3 reaches a certain amount, the front end opening portion of another communicating tube 6 having taken ambient air into the tank is put into a liquid-sealed state and is temporarily closed. Thus, the supply of ambient air into the ink tank 7 is stopped. Simultaneously, the supply of ink to the ink occluding element 3 from the ink tank 7, which has been performed by the communicating tube 6, is stopped. Consequently, the front end opening portion of each of the communicating tubes 6 is brought into a liquid-sealed state and is temporarily closed. The outflow of ink from the ink tank 7 and the inflow of air into the ink tank (that is, the exchange between ink and air) are put into a halting state.

The direct-fluid-supply writing implement 1 according to the seventeenth aspect of the invention is configured so that the front end of each of the communicating tubes 6 is connected to the high density portion 31 of the ink occluding element 3. Thus, all the front end opening portions of the communicating tubes 6 can easily be closed by the liquid-seal due to the ink impregnated in the ink occluding element 3. Consequently, excessive ink is not supplied from the ink tank 7 to the ink occluding element 3. There is no fear that ink leaks out from the pentip 2.

The direct-fluid-supply writing implement 1 according to the eighteenth aspect of the invention has a plurality of communicating tubes 6 (that is, two or more communicating tubes 6. Thus, in a case where at least one communicating tube 6 supplies ink, another communicating tube 6 supplies air. Consequently, at initial ink supply (that is, at the time of initially supplying ink to the ink occluding element 3 in which no ink is impregnated), air and ink can quickly be exchanged. Consequently, in a short time, the writing implement becomes ready for writing.

Preferably, according to an embodiment as set forth in the seventeenth aspect of the invention of the direct-fluid-supply writing implement 1 according to the thirteenth to seventeenth aspect of the invention, the rear end of the pentip 2 is connected through the ink occluding element 3 to the front end of each of the communicating tubes 6 so that ink is flowable therebetween.

According to the direct-fluid-supply writing implement 1 as set forth in the eighteenth aspect of the invention is configured so that the rear end of the pentip 2 is not directly connected to the front end of each of the communicating tubes 6. Thus, a certain amount of ink is impregnated at least in the ink occluding element 3 between the rear end of the pentip 2 and the front end of each of the communicating tubes 6. Consequently, even in a state, such as a pentip upward-pointing state, and a writing-implement-body horizontal state, in which ink is not supplied to the pentip 2 from the ink tank, it is sufficiently possible for the writing implement to write characters.

Preferably, according to an embodiment as set forth in the nineteenth aspect of the invention of the direct-fluid-supply writing implement 1 according to the thirteenth to seventeenth aspect of the invention), the front end of each of the communicating tubes 6 is frontwardly inserted into the ink occluding element 3 from the rear end thereof, and frontwardly compresses the inside of the ink occluding element 3 to thereby set the density of apart of the ink occluding element 3, which is in the vicinity of the front end of each of the communicating tubes 6, to be higher than the density of a portion of the ink occluding element 3, which is other than the part of the ink occluding element 3.

The direct-fluid-supply writing implement 1 according to the nineteenth aspect of the invention is configured so that the ink occluding element 3 has a portion (that is, the high density portion 31), which is provided at a position in the vicinity of the front end of each of the communicating tubes 6 and is set to have a high density, and a portion (that is, the low density portion 31), which is provided at places other than the position in the vicinity of the front end of each of the communicating tubes 6 and is set to have a low density. Thus, ink contained in the ink occluding element 3 can be impregnated in the high density portion 31 in preference to the low density portion 32. Consequently, the front end opening portion of each of the communicating tubes 6 can surely be liquid-sealed by the impregnated ink. Thus, when the internal pressure of the ink tank 7 is reduced due to temperature drop or the like, the ink impregnated in the ink occluding element 3 is not residual in the ink occluding element 3. The ink is properly returned to the ink tank 7 from the high density portion 31 of the ink occluding element 3 through the communicating tube 6.

The direct-fluid-supply writing implement 1 according to the nineteenth aspect of the invention is adapted so that portions differing in density (that is, the high density portion 31 and the low density portion 32 of the ink occluding element 3) are formed in the ink occluding element 3 by frontwardly inserting the front end of each of the communicating tubes 6 into the ink occluding element 3 from the rear end thereof and by frontwardly compressing the inside of the ink occluding element 3. Thus, there is no necessity for preliminarily generating a difference in density in the ink occluding element 3 before the communicating tubes 6 are incorporated into the ink occluding element 3. Consequently, the manufacture of the writing implement can extremely be facilitated.

Preferably, according to an embodiment as set forth in the twentieth aspect of the invention of the direct-fluid-supply writing implement 1 according to the thirteenth to seventeenth aspect of the invention), the front end of each of the communicating tubes 6 is formed into a pointed shape.

The direct-fluid-supply writing implement 1 according to the twentieth aspect of the invention is configured so that the front end of each of the communicating tubes 6 is formed into a pointed shape. Thus, each of the communicating tubes 6 can be smoothly thrust-inserted into the ink occluding element 3 from the rear end thereof. Consequently, there is no need for preliminarily boring a hole, which is used for inserting the communicating tubes, in the ink occluding element 3. Thus, the assembling process of the writing implement can be simplified.

Preferably, according to an embodiment as set forth in the twenty first aspect of the invention of the direct-fluid-supply writing implement 1 according to the twentieth aspect of the invention), the front end of each of the communicating tubes 6 is constituted by an inclined cut surface 61 that includes the front end opening portion thereof.

According to the direct-fluid-supply writing implement 1 as set forth in the twentieth aspect of the invention, the front end of each of the communicating tubes 6, which has a pointed shape, is constituted by an inclined cut surface 61. Thus, the ability to thrust-insert each of the communicating tubes 6 is further enhanced. The area of the opening of the front end opening portion of each of the communicating tubes 6 increases. Consequently, ink can quickly be supplied into the ink occluding element 3.

Preferably, according to an embodiment as set forth in the twenty second aspect of the invention of the direct-fluid-supply writing implement 1 according to the thirteenth to twenty first aspect of the invention, the distance S1 or S2 between the front end of the ink occluding element 3 and each of the communicating tubes 6 is set to be within a range from 3% to 50% of the axial length of the entire ink occluding element 3.

According to the direct-fluid-supply writing implement 1 as set forth in the twenty second aspect of the invention, when the inner pressure of the ink tank 7 rises, ink does not leak out of the front end of the ink occluding element 3. Additionally, sufficient flowability of ink from the pentip 2 can be obtained to thereby prevent occurrence of discontinuity and blur in handwritten characters. In a case where the distance S1 or S2 between the front end of the ink occluding element 3 and each of the communicating tubes 6 is less than 3% of the axial length of the entire ink occluding element 3, there is a fear that ink may leak out of the front end of the ink occluding element 3 when the inner pressure of the ink tank 7 rises. Further, in a case where the distance S1 or S2 between the front end of the ink occluding element 3 and each of the communicating tubes 6 exceeds 50% of the axial length of the entire ink occluding element 3, the distance from the front end of each of the communicating tubes 6 to the front end of the pentip 2 is too long, so that the flowability of the ink may be deteriorated.

Preferably, according to an embodiment as set forth in the twenty third aspect of the invention of the direct-fluid-supply writing implement 1 according to the thirteenth to twenty second aspect of the invention), the distances S1 and S2 from the front end of the ink occluding element 3 to those of the communicating tubes 6 are set to be equal to one another.

According to the direct-fluid-supply writing implement 1 as set forth in the twenty third aspect of the invention, the distance among the front ends of the communicating tubes 6 in the ink occluding element 3 can be further reduced. The liquid-sealability of the front opening portion of each of the communicating tubes 6 can be enhanced. Leakage of ink to the outside can be further prevented.

Preferably, according to an embodiment as set forth in the twenty fourth aspect of the invention of the direct-fluid-supply writing implement 1 according to the thirteenth to twenty third aspect of the invention, the distances T1 and T2 from the rear end of the pentip 2 to the front ends of the communicating tubes 6 are set to be within 10 mm.

According to the direct-fluid-supply writing implement 1 as set forth in the twenty fourth aspect of the invention, at the initial ink supply, ink is quickly supplied from the front end of each of the communicating tubes 6 to the rear end of the pentip 2, the writing implement 1 quickly becomes ready for writing. In a case where the distances T1 and T2 from the rear end of the pentip 2 to the front ends of the communicating tubes 6 exceed 10 mm, the distance between the rear end of the pentip 2 and the front end of each of the communicating tubes 6 is too large. Thus, ink cannot be quickly supplied from the front end of each of the communicating tubes 6 to the rear end of the pentip 2. Consequently, there is a fear that at the initial ink supply, it takes considerable time until the writing implement becomes ready for writing. Incidentally, the front end of each of the communicating tubes 6 maybe placed frontwardly from the rear end of the pentip 2. Alternatively, the front end of each of the communicating tubes 6 maybe placed rearwardly from the rear end of the pentip 2.

Preferably, according to an embodiment as set forth in the twenty fifth aspect of the invention of the direct-fluid-supply writing implement 1 according to the thirteenth to twenty fourth aspect of the invention, the distances from the rear end of the pentip 2 to the front ends of the communicating tubes are set to be equal to one another.

According to the direct-fluid-supply writing implement 1 as set forth in the twenty fifth aspect of the invention, at the initial ink supply, regardless of which communicating tube 6 supplies ink to the rear end of the pentip 2 from the front end opening portion thereof, in a constant time, the writing implement 1 becomes ready for writing, without variation.

Preferably, according to an embodiment as set forth in the twenty sixth aspect of the invention of the direct-fluid-supply writing implement 1 according to the thirteenth to twenty fifth aspect of the invention, the front end surface and the rear end surface of the ink occluding element 3 communicate with ambient air.

According to the direct-fluid-supply writing implement 1 as set forth in the twenty sixth aspect of the invention, air contained in the ink occluding element 3 can be let out from the front end surface and the rear end surface of the ink occluding element 3. Consequently, ink supplied from the front end opening portion of the communicating tube 6 in the ink occluding element 3 can smoothly be moved from the vicinity of the front end of the communicating tube 6 in the ink occluding element 3 toward the front end of the ink occluding element 3 and from the inside of the ink occluding element 3 toward the rear end of the ink occluding element 3. Especially, when the rear end surface of the ink occluding element 3 communicates with ambient air to thereby increase the inner pressure of the ink tank 7 due to the rise of temperature or the like, ink pushed out of the ink tank 7 is smoothly and rearwardly moved from the front end of the communicating tube 6 through the vicinity of the front end of the communicating tube 6 in the ink occluding element 3. Then, the moved ink is impregnated in the rear portion of the ink occluding element 3. Thus, the ink is prevented from leaking out therefrom. Meanwhile, when the inner pressure of the ink tank 7 is reduced due to the drop of temperature or the like, the ink impregnated in the ink occluding element 3 can be returned to the inside of the ink tank 7 from the front end opening portion of the communicating tube 6 through the vicinity of the front end of the communicating tube 6 in the ink occluding element 3 and through the communicating tube 6.

Preferably, according to an embodiment as set forth in the twenty seventh aspect of the invention of the direct-fluid-supply writing implement 1 according to the thirteenth to twenty sixth aspect of the invention is configured so that an ink absorbing element 63 having a capillary gap is disposed in each of the communicating tubes 6.

According to the direct-fluid-supply writing implement 1 as set forth in the twenty seventh aspect of the invention, even when the outside diameter and the inside diameter of each of the communicating tubes 6 are set at relatively large values so as to prevent the communicating tubes 6 from being bent, respectively, the front end opening portion of each of the communicating tubes 6 can appropriately be liquid-sealed.

Preferably, according to an embodiment as set forth in the twenty eighth aspect of the invention of the direct-fluid-supply writing implement 1 according to the thirteenth to twenty seventh aspect of the invention, the side walls of the communicating tubes 6 are connected to one another.

According to the direct-fluid-supply writing implement 1 as set forth in the twenty eighth aspect of the invention, the bending strength of each of the communicating tubes 6 is enhanced. Each of the communicating tubes 6 can be suppressed from being bent.

(Communicating Tubes)

Incidentally, according to the invention, preferably, the communicating tubes 6 have certain stiffness. Thus, the communicating tubes 6 are made of synthetic resins or metal materials. The shapes of the transverse cross-sections of the communicating tubes 6 maybe, for example, a circle, an ellipsoid, or a polygon, such as a triangle, and a quadrangle.

Additionally, it is advisable that the number of the communicating tubes 6 is a plural number (that is, two or more), for instance, 2, 3, 4, 5, or 6. Each of the communicating tubes 6 is extended in an anteroposterior direction. A flow passage 62 is provided in each of the communicating tubes 6 to penetrate therethrough. Further, it is advisable to adapt the plural communicating tubes 6 so that the plural flow passages 62 are provided in parallel independent of one another. For example, the communicating tubes 6 may be configured to be radially separated from one another (see FIGS. 1 to 6). Alternatively, the communicating tubes 6 may be configured so that the side walls thereof are connected to each other (see FIGS. 7 to 9). Alternatively, the communicating tubes 6 may be configured so that a small-diameter communicating tube 6*b* is disposed in a large-diameter communicating tube 6*a* (see FIG. 10). Preferably, the front ends of the communicating tubes 6 are arranged at uniform intervals on the same circumference of a circle centered at the pentip 2. In addition, each of the front end of the communicating tube 6 may open to frontward of a longitudinal direction of the writing implement, or open to radially outward of the writing implement. As a shape of the front end of the communicating tube 6, for example, obliquely cut-out face, perpendicular face, cone-face, protrude-curved face are adoptable.

(Ink Occluding Element)

Incidentally, according to the invention, it is advisable that the ink occluding element is made of a material, which can be impregnated with ink and has continuous pores (that is, a porous material). Examples of such a material are a material obtained by heat-sealing of a fiber bundle, a material obtained by resin-treating a fiber bundle, a material obtained by resin-treating felt, a material obtained by needle-punching felt, and a material made of a continuous synthetic resin foaming material. Alternatively, the ink occluding element 3 may be configured to have a coat, which is constituted by a synthetic film and is provided on the outer peripheral surface. Incidentally, the expression "inner front portion" designates the inner part of a front half of the ink occluding element 3. The ink occluding element 3 may be constituted by either a single member or a plurality of members that differ from one another in capillary force.

(Pentip)

Incidentally, the pentip according to the invention is constituted by, for example, an element obtained by resin-treating a fiber bundle, an element obtained by heat-sealing of a fiber bundle, an element obtained by resin-treating felt, a pipe-like pen body, a fountain pen type plate-like body having a slit at a tip end thereof, a brush pen body, an element made of a synthetic resin porous material, a ballpoint pen tip, and an element that is obtained by extrusion-molding of a synthetic resin and that has an axial ink induction passage. It is advisable that the material constituting the rear end of the pentip 2 has at least a capillary gap so as to enable appropriate connection between the pentip 2 and the ink occluding element 3. Such a material is, for instance, a material obtained by resin-treating a fiber bundle, a material obtained by heat-sealing of a fiber bundle, a material obtained by treating felt, a porous material, such as a synthetic resin porous material, and a material that is obtained by extrusion-molding of a synthetic resin and that has an axial ink induction passage.

(Ink Absorbing Element)

Incidentally, any element may be employed as the ink absorbing element 63, as long as this element has a capillary gap. The material of the ink absorbing element is, for example, a material obtained by resin-treating a fiber bundle, a material obtained by heat-sealing of a fiber bundle, a material obtained by treating felt, a porous material, such as a synthetic resin porous material, and a material obtained by extrusion-molding of a synthetic resin. Incidentally, it is preferable that the capillary force of the ink absorbing member 63 is set to be less than the capillary force of the portion (that is, the high density portion 31) in the vicinity of the front end of each of the communicating tubes 6 in the ink occluding element 3.

EMBODIMENTS

First Embodiment

Figure 2:
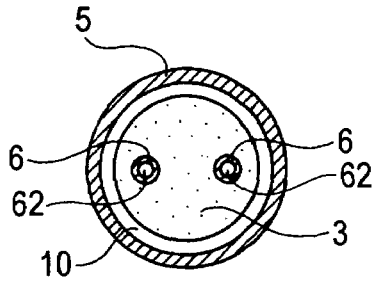
FIG. 2 is a cross-sectional view taken on line A-A shown in FIG. 1.

FIGS. 1 and 2 show a direct-fluid-supply writing implement 1 according to a first embodiment of the invention.

The direct-fluid-supply writing implement 1 according to this embodiment includes a pentip 2, an ink occluding element 3, an ink occluding element accommodating portion that holds the pentip 2 at a front end portion thereof and that stores the ink occluding element 3 therein, an ink tank 7 that is attached to the rear of the occluding element accommodating portion and that directly stores ink 8, a partition wall 52 that separates the occluding element accommodating portion from the ink tank 7, and a plurality of (actually, two) communicating tubes 6 that are protruded frontwardly from the front surface of the partition wall 52 and that are stick-connected to the inside of the ink occluding element 3. The occluding element accommodating portion includes an end member 4, which holds the pentip 2, and an intermediate member 5 that connects the end member 4 to the ink tank 7.

Pentip

The pentip 2 is a bar-like element obtained by resin-treating synthetic resin fibers (for example, polyester fibers, acrylic fibers, nylon fibers). An end of the pentip 2 is ground like a bombshell. The outer peripheral surface of the pentip 2 is chamfered like a tapered surface. An annular groove 21 is formed in an intermediate portion of the pentip 2.

Ink Occluding Element

The ink occluding element 3 is a cylindrical processed element obtained by treating synthetic resin fibers (for instance, polyester fibers). The outer peripheral surface of the ink occluding element 3 is covered with a cylindrical coat. The coat is constituted by a synthetic resin film (for example, a polyethylene terephthalate film). The rear end of the pentip 2 is thrust-inserted into the center of an axis of the front end surface of the ink occluding element 3. The rear end of the pentip 2 is placed in front of the inside of the ink occluding element 3.

End Member

The end member 4 is a cylindrical member obtained by injection-molding of synthetic resin (for example, polypropylene, and polyethylene). The end member 4 includes a small-diameter portion 41, which holds the outer peripheral surface of the pentip 2, and a large-diameter portion 42 that is provided continuously and rearwardly from the small-diameter portion 41 and holds the outer peripheral surface of the ink occluding element 3.

Plural ribs 43 extending in an anteroposterior direction are integrally formed on the inner surface of the end member 4 (that is, the surface extending from the inner surface of the small-diameter 41 to the inner surface of the large-diameter 42). The ribs 43 are configured so that a step-like regulating wall portion 43*a* is formed on an intermediate portion between the small-diameter portion 41 and the large-diameter portion 42 of the end member 4. The front end of the ink occluding element 3 radially abuts against the regulating wall portion 43*a*. The front outer peripheral surface of the ink occluding element 3 is pressure-contacted to and is held by the ribs 43 on the inner surface of the large-diameter portion 42. The ribs 43 are configured so that an engaging convex portion 43*b* is formed on the inner surface of the small-diameter portion 41, that the outer peripheral surface of the pentip 2 is radially pressure-contacted to and held by the ribs 43 on the inner surface of the small-diameter portion 41, and that the annular groove 21 provided in the outer peripheral surface of the pentip 2 engages with the engaging convex portion 43*b* to thereby regulate the anteroposterior movement of the pentip 2.

Air passages 10 are formed by the ribs 43 between the front outer peripheral surface of the ink occluding element 3 and the inner surface of the large-diameter portion 42, between the front end surface of the ink occluding element 3 and the inner surface of the intermediate portion of the end member 4, and between the outer peripheral surface of the pentip 2 and the inner surface of the small-diameter portion 41. A front part of the air passage 10 is opened to the outside from the front end of the end member 4. A rear part of the air passage 10 communicates with the rear end surface of the ink occluding element 3. That is, the front end surface of the ink occluding element 3 and the rear end surface thereof are made by the air passage 10 to communicate with ambient air.

Intermediate Member

The intermediate member 5 is a cylindrical member obtained by injection-molding of synthetic resin (for example, polypropylene, and polyethylene). The intermediate member 5 is formed by integrally and continuously providing a front cylindrical portion 51 opened frontwardly, a partition wall 52 formed on the bottom portion of the front cylindrical portion 51, a rear cylindrical portion 53 opened rearwardly, and a plurality of (actually, two) of communicating tubes 6 projected axially and frontwardly from the front surface of the partition wall 52. In this embodiment, the partition wall 52 and the communicating tubes 6 are integrally and continuously provided. Alternatively, the partition wall 52 and the communicating tubes 6 may be formed as separate members and may be firmly fixed to one another.

The outer peripheral surface of the large-diameter portion 42 of the end member 4 is press-fitted into and is firmly fixed to the inner peripheral surface of the front cylindrical portion 51. The ink occluding element 3 is accommodated in a space (that is, the occluding element accommodating portion) defined by the front cylindrical portion 51, the partition wall 52, and the large-diameter portion 42 of the end member 4. An opening portion of the ink tank 7 is detachably attached to the rear cylindrical portion 53. More specifically, the opening portion of the ink tank 7 is detachably attached to the rear cylindrical portion 53 by screwing.

The partition wall 52 and the rear end surface of the ink occluding element 3 are maintained in a non-contact state. A gap 9 communicating with ambient air is formed therebetween. The gap 9 communicates with ambient air through the air passage 10.

Communicating Tubes

A flow passage 62 extending axially is formed in each of the communicating tubes 6, and is opened at both ends of each of the communicating tubes 6. The front end of each of the communicating tubes 6 is opened to the front inner portion of the ink occluding element 3. The rear end of each of the communicating tubes 6 is opened to the inside of the ink tank 7 in the rear of the ink occluding element 3. The plural communicating tubes 6 are arranged in parallel between the ink occluding element 3 and the ink tank 7. Thus, the plural independent flow passages 62 are provided in parallel between the ink occluding element 3 and the ink tank 5 placed in the rear thereof.

The front end of each of the communicating tubes 6 is constituted by one inclined cut surface 61 and is thus tapered. The front end of each of the communicating tubes 6 is frontwardly thrust-inserted into the ink occluding element 3 from the rear end thereof. Finally, the front end of each of the communicating tubes 6 is disposed at the inner from portion of the ink occluding element 3 in the vicinity of the rear end of the pentip 2. When the front end of each of the communicating tubes 6 is thrust-inserted into the ink occluding element 3, the front end of each of the communicating tubes 6 frontwardly pushes and compresses the fibers of the ink occluding element 3. Consequently, the density of the fibers of a part of the ink occluding element 3, which part is located in the vicinity of the front end of each of the communicating tubes 6, is set to be higher than the density of the fibers of the other parts of the ink occluding element 3. That is, a high density portion 31 that is high in density of the fibers, and a low density portion 32 that is low in density of the fibers, are formed in the ink occluding element 3. Because the front end of each of the communicating elements 3 is placed in front of the inside of the ink occluding element 3, the high density portion 31 is formed at an inner front portion of the ink occluding element 3, while the low density portion 32 is formed at an inner rear portion of the ink occluding element 3. Each of the communicating tubes 6 is frontwardly passed through the low density portion 32 from the rear thereof. The front end of each of the communicating tubes 6 is placed in the inside of the high density portion 31 that is disposed frontwardly from the low density portion 32. Further, in the embodiment, void ratio (hole ratio) of the low density portion 32 is set to be 85% or more and 93% or less. In the present invention, it is preferable to set the void ratio of the low density portion to be 70% or more and 95% or less. Furthermore, a gap between the void ratio of the low density portion 32 and a void ratio of the high density portion 31 is set to be 20%. In the present invention, it is preferable that the gap between the void ratio of the low density portion 32 and the void ratio of the high density portion is set to be 7% or more, and more preferably, the gap is set to be 10% or more.

The front end of each of the communicating tubes 6 is disposed at a place deviated radially and outwardly from the center of an axis of the ink occluding element 3. More specifically, the front ends of the communicating tubes 6 are arranged at uniform intervals on the same circle centered at the center of the axis of the ink occluding element 3. Because this embodiment has two communicating tubes 6, the communicating tubes 6 are disposed at positions that are symmetrical with the center of the axis of the ink occluding element 3 and that are 180 degrees angularly apart from each other. Because the pentip 2 is placed on the central axis of the ink occluding element 3, the front end of each of the communicating tubes 6 is not directly connected to the rear end of the pentip 2, and is in a non-contact state in which the front end of each of the communicating tubes 6 is not in contact with the pentip 2. Thus, the front end of each of the communicating tubes 6 is connected to the rear end of the pentip 2 through the inner front portion of the ink occluding element 3 so that ink can flow therethrough. Further, the front end of each of the communicating tubes 6 is placed slightly frontwardly from the rear end of the pentip 2.

The inclined cut surface 61 at the front end of each of the communicating tubes 6 is formed to include the front end opening portion of each of the communicating tubes 6. The inclined cut surface 61 (that is, the front end opening portion of each of the communicating tubes 6) is directed toward the central axis of the ink occluding element 3 (that is, toward the rear end of the pentip 2). Consequently, ink can quickly be supplied to the rear end of the pentip 2. Also, the front end of each of the communicating tubes 6 can appropriately push and compress the fibers in the vicinity of the pentip 2. Thus, the density of the fibers in the vicinity of the pentip 2 can easily be set at a high value. In this embodiment, the transversal cross-sections of the outer surface and the inner surface of each of the communicating tubes 6 are circular. The transversal cross-sections of the outer peripheral edge and the inner peripheral edge of the front end of each of the communicating tubes 6 are elliptical due to the presence of the inclined cut surface 61.

Axial Distance

Incidentally, in this embodiment, the axial length L of the entire ink occluding element 3 is set to be 30 mm. Also, in this embodiment, both the axial distance S1 between the front end of the ink occluding element 3 and the front end of one of the communicating tubes 6 and the axial distance S2 between the front end of the ink occluding element 3 and the front end of the other communicating tube 6 are set at 4 mm. Thus, the axial distance S1 between the front end of the ink occluding element 3 and the front end of one of the communicating tubes 6 and the axial distance S2 between the front end of the ink occluding element 3 and the front end of the other communicating tube 6 are 13.3% (that is, within a rage of 3% to 50%) of the axial length L of the entire ink occluding element 3. Further, even in this embodiment, both the axial distance T1 between the pentip 2 and the front end of one of the communicating tubes 6 and the axial distance T2 between the pentip 2 and the front end of the other communicating tube 6 are set to be 1 mm (that is, less than 10 mm).

Ink Tank

The ink tank 7 is a bottomed cylindrical element that is opened at the front end and is closed at the rear end. The ink tank 7 is obtained by injection-molding or blow-molding of synthetic resin. Ink 8 is directly stored in the ink tank 7. The ink 8 stored in the ink tank 7 may be either aqueous ink or oil-based ink.

The front opening portion of the ink tank 7 is detachably attached to the intermediate member 5. In a case where the ink 8 contained in the ink tank 7 is expended, so that the writing implement cannot write, the ink tank 7 is detached from the intermediate member 5. Then, the ink tank 7 is refilled with ink 8. Alternatively, the ink tank 7 is replaced with a new ink tank 7 filled with ink 8. Thereafter, the ink tank 7 filled with ink 8 is attached to the intermediate member 5. Thus, the writing implement is enabled again to write.

Second Embodiment

Figure 3:
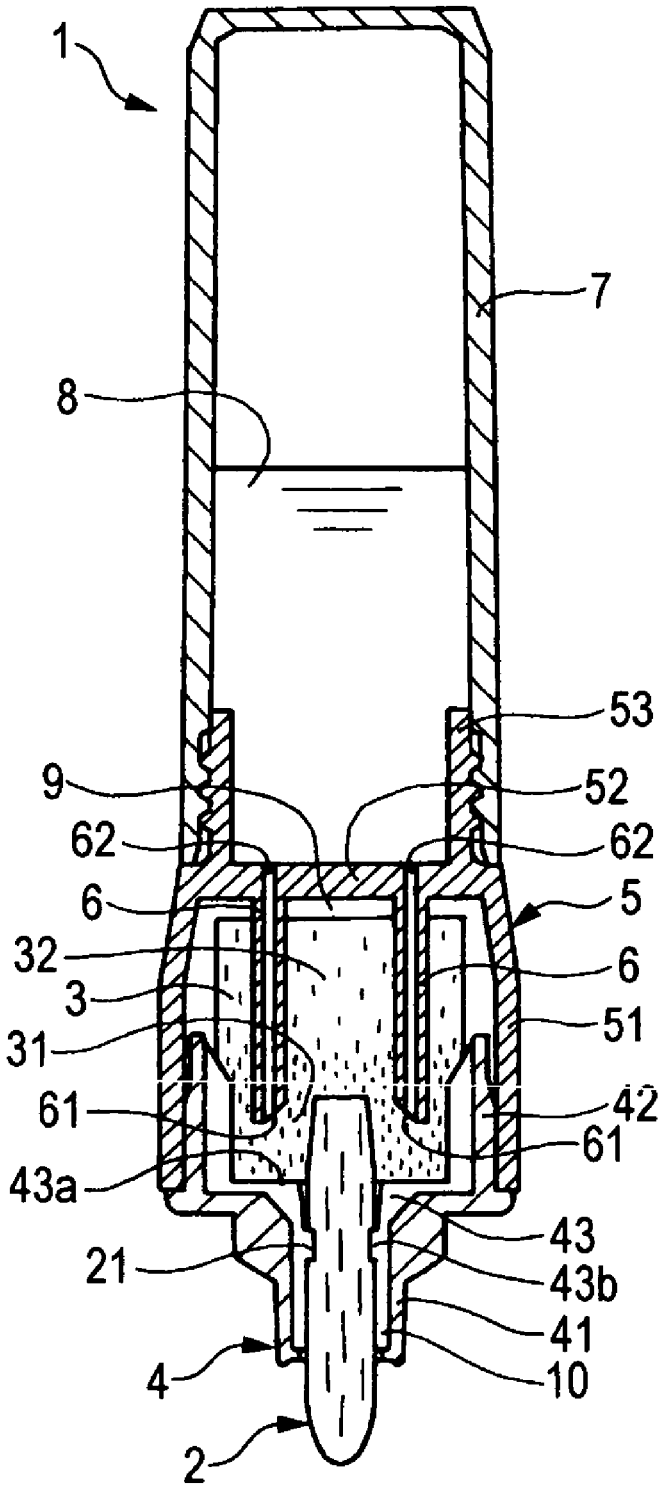
FIG. 3 is a longitudinally cross-sectional view illustrating a pentip downward-pointing state of a second embodiment of the invention.

FIG. 3 shows a second embodiment of the invention.

This embodiment is a modification of the first embodiment and differs from the first embodiment in that the high density portion 31 is formed at the front portion of the ink occluding element 3 by compressing radially and inwardly the front outer peripheral surface of the ink occluding element 3.

The diameter of an inscribing circle of the plural ribs 43 formed on the inner surface of the large-diameter portion 42 of the end member 4 is set to be relatively larger than the outside diameter of the front portion of the ink occluding element 3. The ink occluding element 3 has a uniform anteroposterior density distribution before press-fitted into the end member 4. When the front portion of the ink occluding element 3 is press-fitted into the large-diameter portion of the end member 4, the front outer peripheral surface of the ink occluding element 3 is radially and inwardly pressure-compressed. Consequently, the high density portion 31 is formed at the front portion of the ink occluding element 3. Simultaneously, the low density portion 32 is formed at the rear portion of the high density portion 31, because the outer peripheral surface of the ink occluding element 3 is not radially compressed. The rear end of the pentip 2 and the front end of each of the communicating tubes 6 are placed at the radially inner portion of the ribs 43 provided on the inner surface of the large-diameter portion 42. Thus, the high density portion 31 can properly be formed in the vicinity of the front end of each of the communicating tubes 6 and in the proximity of the rear end of the pentip 2. Incidentally, the remaining components of this embodiment are similar to the corresponding components of the first embodiment. Thus, the description of the remaining components of the sixth embodiment is omitted herein.

Third Embodiment

Figure 4:
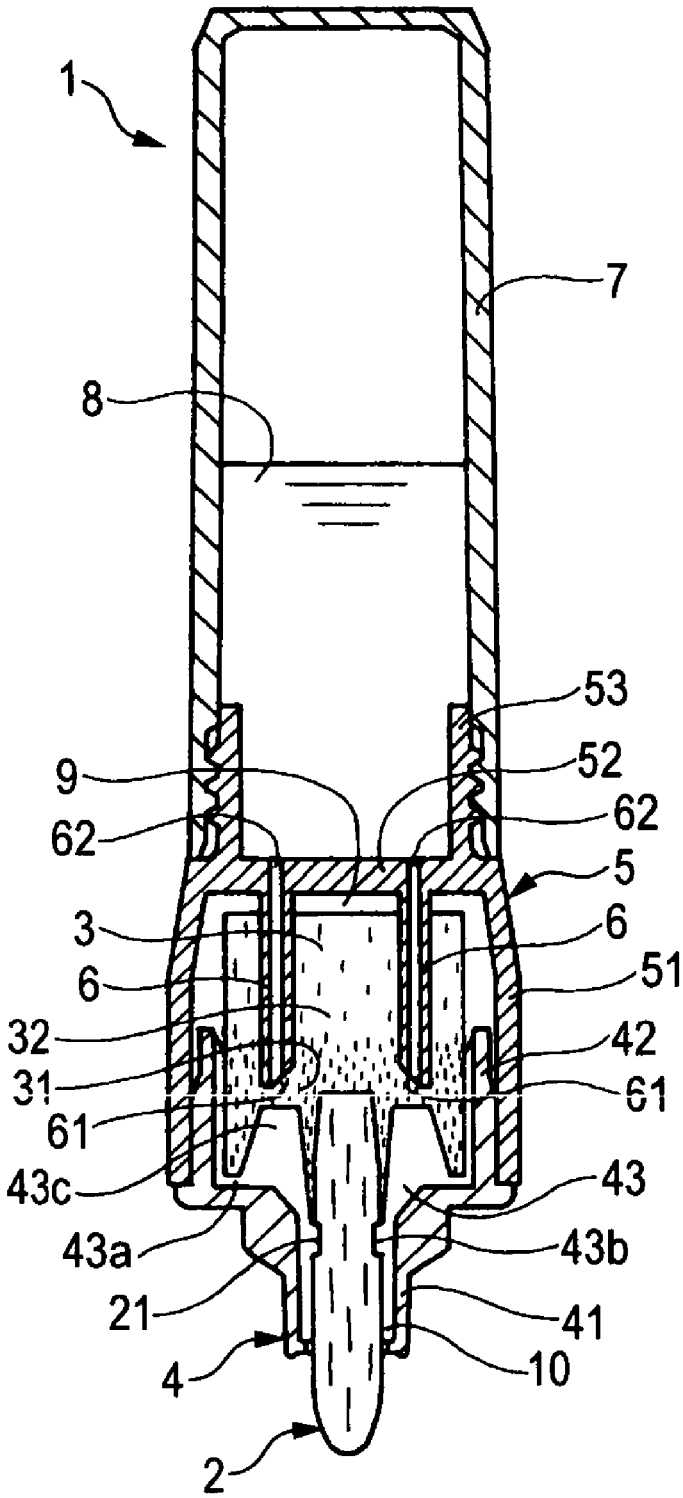
FIG. 4 is a longitudinally cross-sectional view illustrating a pentip downward-pointing state of a third embodiment of the invention.

FIG. 4 shows a third embodiment of the invention.

This embodiment is a modification of the first embodiment and differs from the first embodiment in that the high density portion 31 is formed at the front portion of the ink occluding element 3 by compressing rearwardly the front outer peripheral surface of the ink occluding element 3.

A projection portion 43*c* protruding rearwardly and largely is formed integrally with the regulating wall portion 43*a* of each of the plural rib 43 formed on the inner surface of the end member 4. The ink occluding element 3 has a uniform anteroposterior density distribution before press-fitted into the end member 4. When the front portion of the ink occluding element 3 is inserted into the large-diameter portion of the end member 4, the projection portion 43*c* is deeply inserted into the front end portion of the ink occluding element 3. The front end surface of the ink occluding element 3 is rearwardly pressure-compressed. Consequently, the high density portion 31 is formed at the front portion of the ink occluding element 3. Simultaneously, the low density portion 32 is formed at the rear portion of the high density portion 31, because the outer peripheral surface of the ink occluding element 3 is not radially compressed. The rear end of the projection portion 43*c* is placed in the vicinity of the front end of each of the communicating tubes 6 and in the proximity of rear end of the pentip 2. Consequently, the high density portion 31 can properly be formed in the vicinity of the front end of each of the communicating tubes 6 and in the proximity of the rear end of the pentip 2. Incidentally, the remaining components of this embodiment are similar to the corresponding components of the first embodiment. Thus, the description of the remaining components of the sixth embodiment is omitted herein.

Fourth Embodiment

Figure 5:
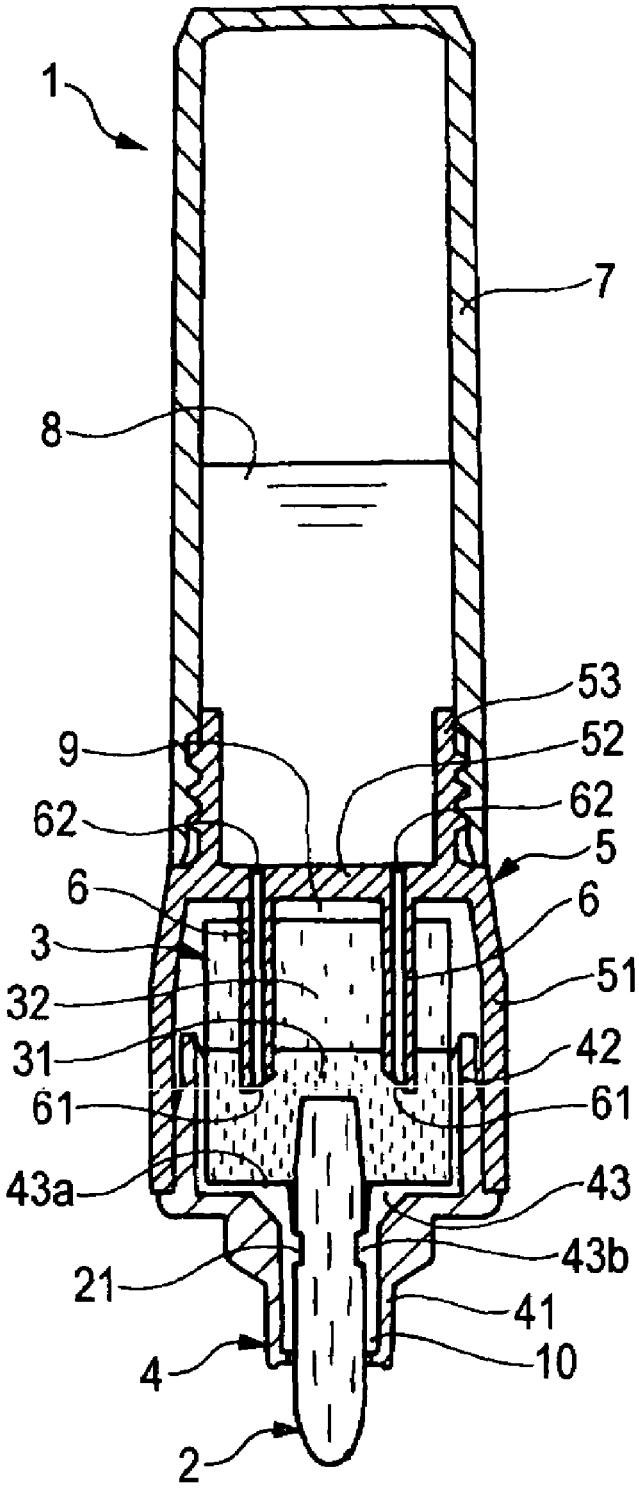
FIG. 5 is a longitudinally cross-sectional view illustrating a pentip downward-pointing state of a fourth embodiment of the invention.

FIG. 5 shows a fourth embodiment of the invention.

This embodiment is a modification of the first embodiment and differs from the first embodiment in that the ink occluding element 3 includes a first ink occluding member, which constitutes the high density portion 31, and also includes a second ink occluding member constituting the low density portion 32.

The density of the fibers of the first ink occluding member is preliminarily set at a high value. Also, the density of the fibers of the second ink occluding member is preliminarily set to be lower than that of the fibers of the first ink occluding member. The rear end surface of the first ink occluding member is placed to be in contact with the front end surface of the second ink occluding member. Each of the communicating tubes 6 axially penetrates through the second ink occluding member. The front end of each of the communicating tubes 6 is frontwardly stuck from the rear end surface of the ink occluding element 3 to and is connected to the first ink occluding member. Also, the rear end of the pentip 2 is rearwardly stuck from the front end surface of the first ink occluding member to and is connected to the first ink occluding member. Consequently, the high density portion 31 can properly be formed in the vicinity of the front end of each of the communicating tubes 6 and in the proximity of the rear end of the pentip 2. Incidentally, the remaining components of this embodiment are similar to the corresponding components of the first embodiment. Thus, the description of the remaining components of the sixth embodiment is omitted herein.

Fifth Embodiment

Figure 6:
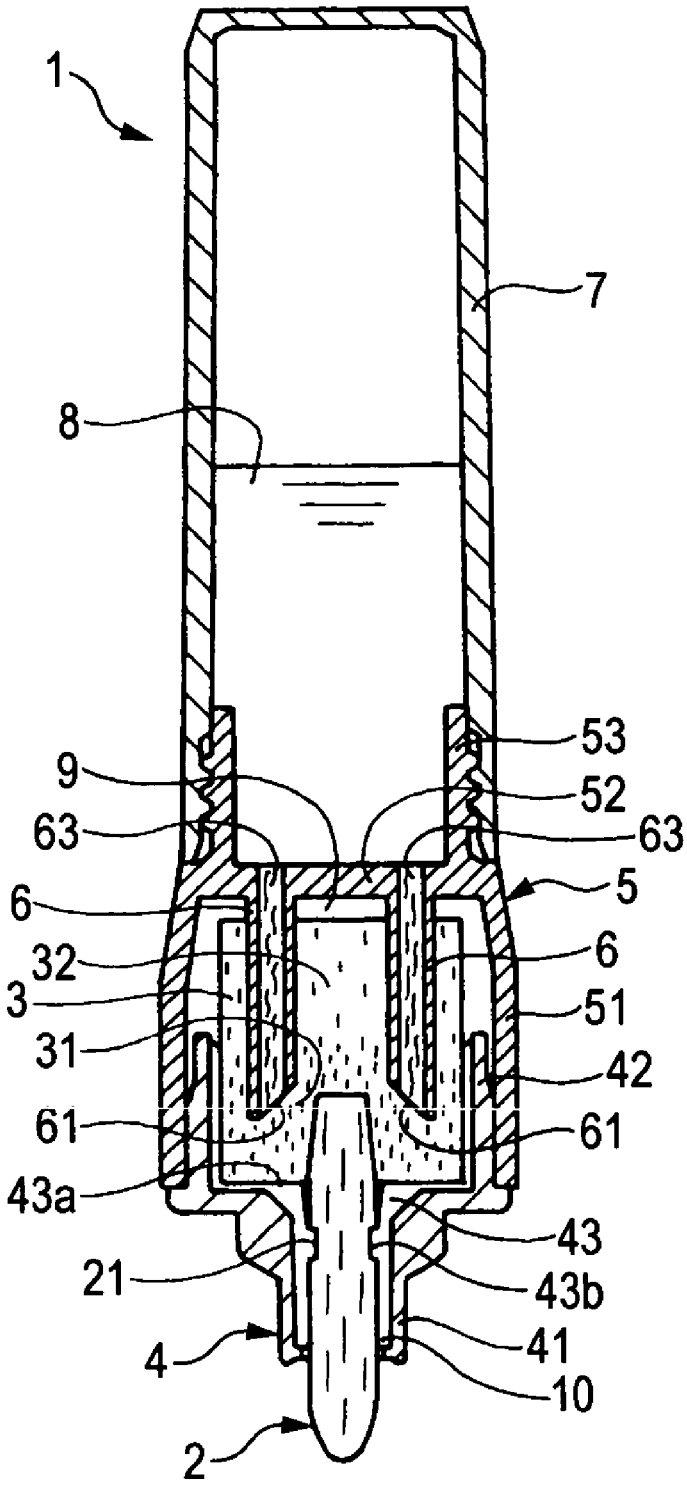
FIG. 6 is a longitudinally cross-sectional view illustrating a pentip downward-pointing state of a fifth embodiment of the invention.

FIG. 6 shows a fifth embodiment of the invention.

This embodiment is a modification of the first embodiment and differs from the first embodiment in that an ink absorbing element 63 constituted by a fiber-processed element is accommodated in the flow passage 62 of each of the communicating tubes 6. The density of the fibers of the ink absorbing element 63 (that is, the capillary force of the ink absorbing element 63) is set to be lower than that of the fibers of the high density portion 31 of the ink occluding element 3 (that is, the capillary force of the high density portion 31). Because the ink absorbing element 63 is accommodated in each of the communicating tubes 6, the front end opening portion of each of the communicating tubes 6 can appropriately be liquid-sealed even in a case where the outside diameter and the inside diameter of each of the communicating tubes 6 are set at relatively large values, respectively. Consequently, the outside diameter and the inside diameter of each of the communicating tubes 6 can be set at relatively large values, respectively. This is advantageous in preventing each of the communicating tubes 6 from being bent. Incidentally, the remaining components of this embodiment are similar to the corresponding components of the first embodiment. Thus, the description of the remaining components of the sixth embodiment is omitted herein.

Sixth Embodiment

Figure 7:
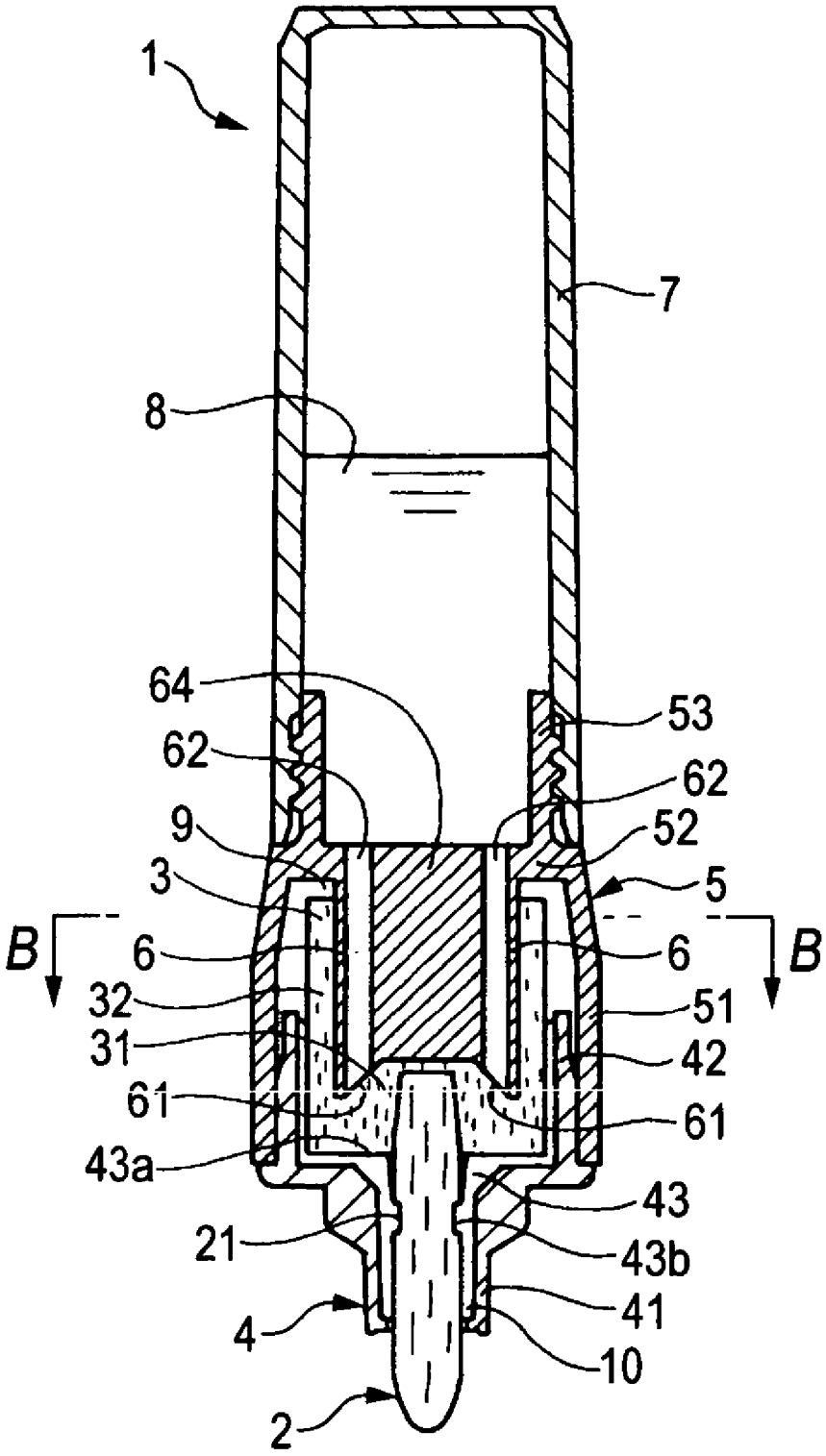
FIG. 7 is a longitudinally cross-sectional view illustrating a pentip downward-pointing state of a sixth embodiment of the invention.
Figure 8:
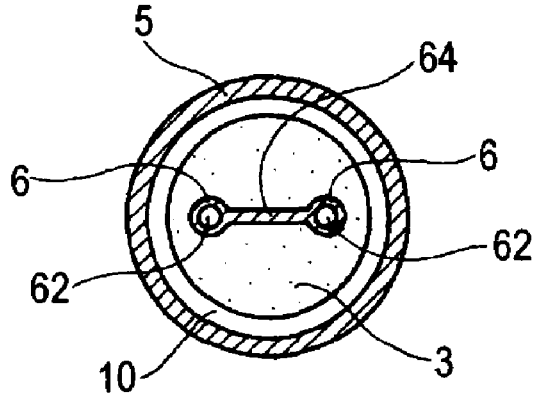
FIG. 8 is a cross-sectional view taken on line B-B shown in FIG. 7.

FIGS. 7 and 8 show a sixth embodiment of the invention.

This embodiment is a modification of the first embodiment and differs from the first embodiment in that the side wall of the communicating tubes 6 are integrally connected to each other by a plate-like rib 64 extending axially. Consequently, the bending strength of each of the communicating tubes 6 is enhanced. Each of the communicating tubes 6 can stably be thrust-inserted into the ink occluding element 3. Incidentally, the remaining components of this embodiment are similar to the corresponding components of the first embodiment. Thus, the description of the remaining components of the sixth embodiment is omitted herein.

Figure 9:
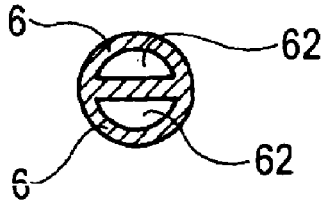
FIG. 9 is a transversally cross-sectional view illustrating another example of a communicating tube.

FIG. 9 shows another example of the communicating tube 6.

This is an example in which the side walls of the communicating tubes 6 are connected to each other. That is, in this example, the inside of one cylindrical element is partitioned by a partition wall extending longitudinally. In other words, two transversally cross-sectionally crescent shaped communicating tubes 6 are integrally connected to each other. Consequently, the two transversally cross-sectionally crescent shaped communicating tubes 6 are provided in parallel in the cylindrical element independent of each other.

Figure 10:
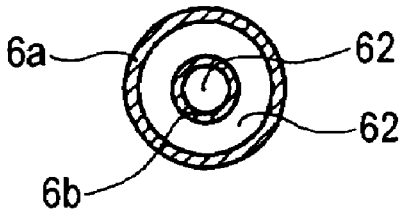
FIG. 10 is a transversally cross-sectional view illustrating another example of a communicating tube.

FIG. 10 shows still another example of the communicating tube 6.

This is an example in which a small-diameter communicating tube 6*b* is disposed in a large-diameter communicating tube 6*a*. In this example, a transversally cross-sectionally annular shaped flow passage 62 is formed between the inner peripheral surface of the large-diameter communicating tube 6 and the outer peripheral surface of the small-diameter communicating tube 6*b*. A transversally cross-sectionally annular shaped flow passage 62 is formed in the small-diameter communicating tube 6*b*.

Seventh Embodiment

Figure 11:
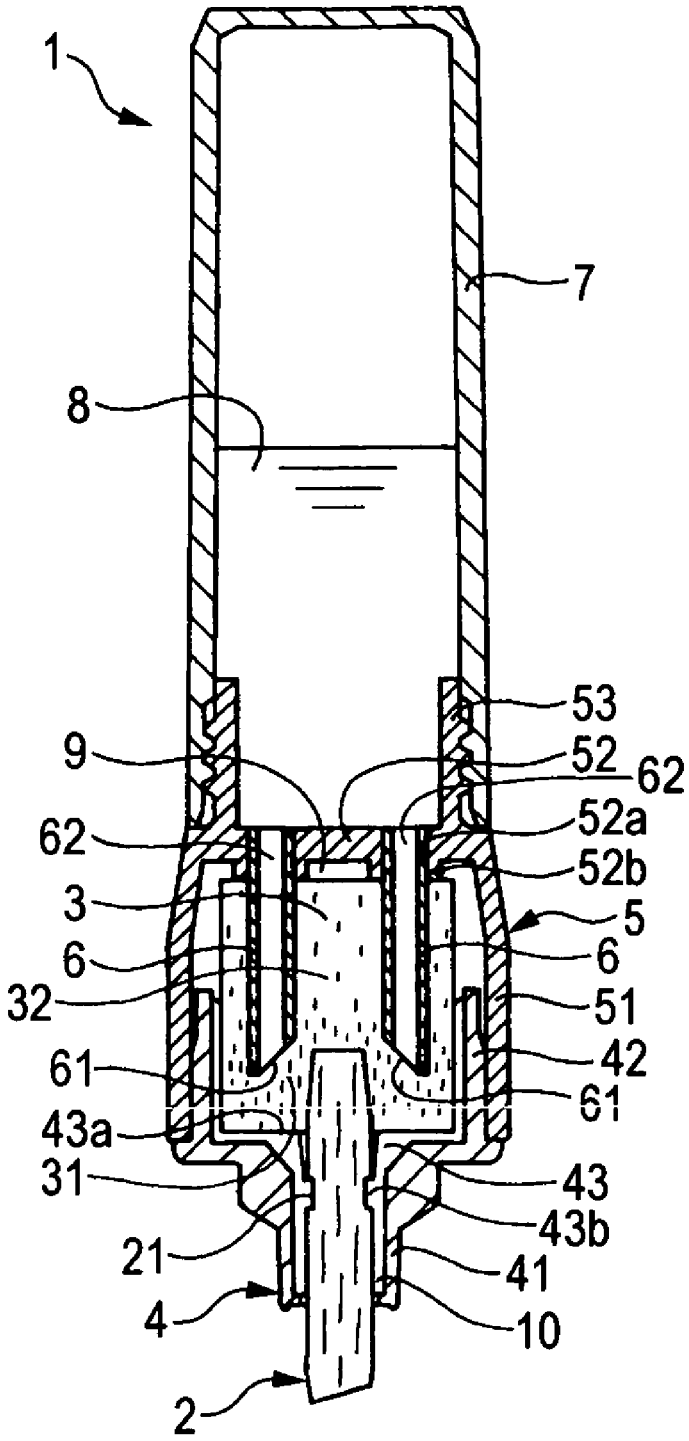
FIG. 11 is a longitudinally cross-sectional view illustrating a pentip downward-pointing state of a seventh embodiment of the invention.

FIG. 11 shows a seventh embodiment of the invention.

This embodiment is a modification of the first embodiment and differs from the first embodiment in that the end of the pentip 2 has a chisel shape, and that the partition wall 52 and the communicating tubes 6 are formed as separate members.

Two mounting holes 52*a* are provided in the partition wall 52 to penetrate therethrough in an anteroposterior direction. The communicating tube 6 is press-fitted into and is firmly fixed to each of the mounting holes 52*a*. An annular convex portion 52*b*, in which the mounting holes 52*a* are frontwardly opened, is formed integrally with the front surface of the separation wall 52. The annular convex portion 52*b* is made to abut against the rear end surface of the ink occluding element 3. A gap 9, whose size is determined according to the dimension of projection of the annular convex portion 52*b*, is properly formed between the rear end surface of the ink occluding element 3 and the separation wall 52. The front end surface of the ink occluding element 3 is made to abut against the regulating wall portion 43*a*. The annular convex portion 52*b* abuts against the rear end surface of the ink occluding element 3. With this configuration, backlash can be prevented from occurring in an anteroposterior direction of the ink occluding element 3. Incidentally, the remaining components of this embodiment are similar to the corresponding components of the first embodiment. Thus, the description of the remaining components of the sixth embodiment is omitted herein.

Eighth Embodiment

Figure 12:
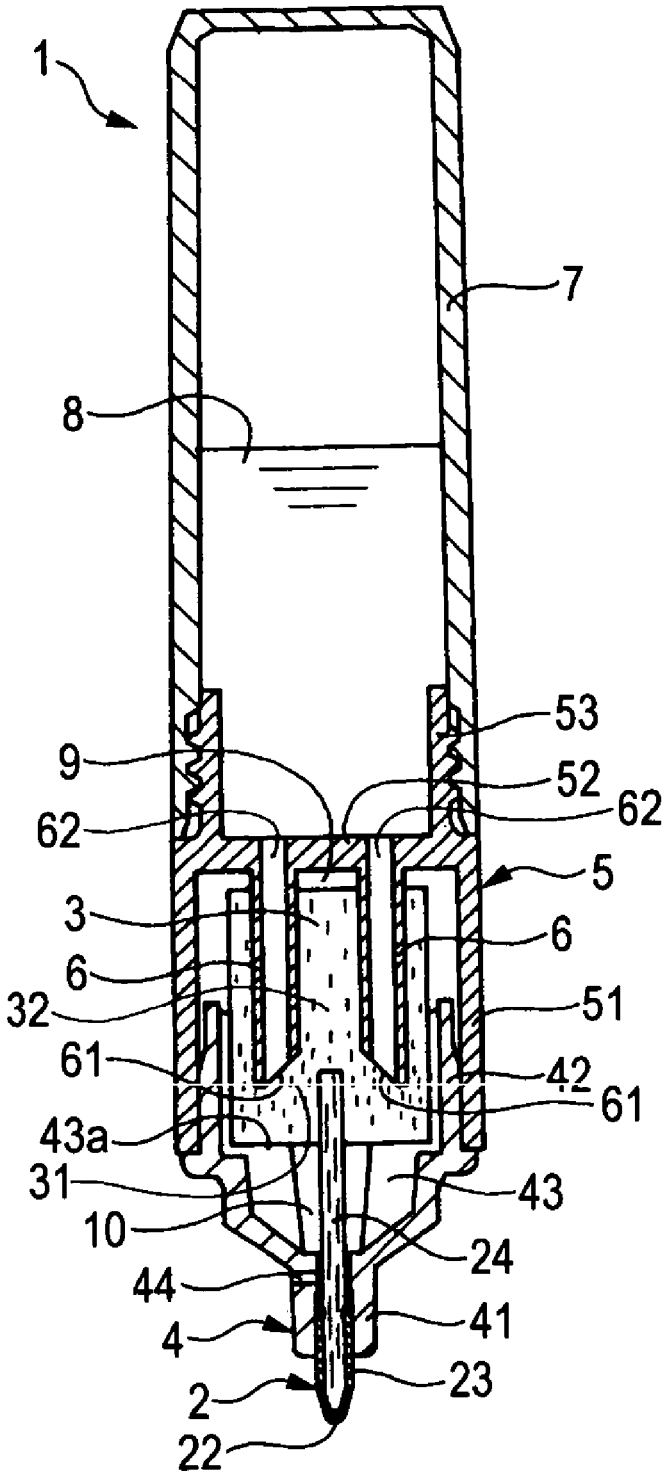
FIG. 12 is a longitudinally cross-sectional view illustrating a pentip downward-pointing state of an eighth embodiment of the invention.

FIG. 12 shows an eighth embodiment of the invention.

This embodiment is a modification of the first embodiment. The pentip 2 is constituted by a ballpoint-pen tip. The pentip 2 includes a holder 23, at an end of which a ballpoint 22 is rotatably held, and an ink inducing member 24 to be inserted into the holder 23. The ink inducing member 24 is a bar-like resin-treated element formed of synthetic-resin fibers. The rear end of the ink inducing member 24 is thrust-inserted into the ink occluding element 3 from the front end thereof and is placed at a inner front part of the ink occluding element 3. Further, an air hole 44 is bored in a sidewall of a small-diameter portion 41 of an end member 4. An air passage 10 provided in the end member 4 communicates with ambient air through the air hole 44. Incidentally, the remaining constituents of the eighth embodiment are similar to the corresponding constituents of the first embodiment. Thus, the description of such constituents is omitted herein.

Ninth Embodiment

Figure 13:
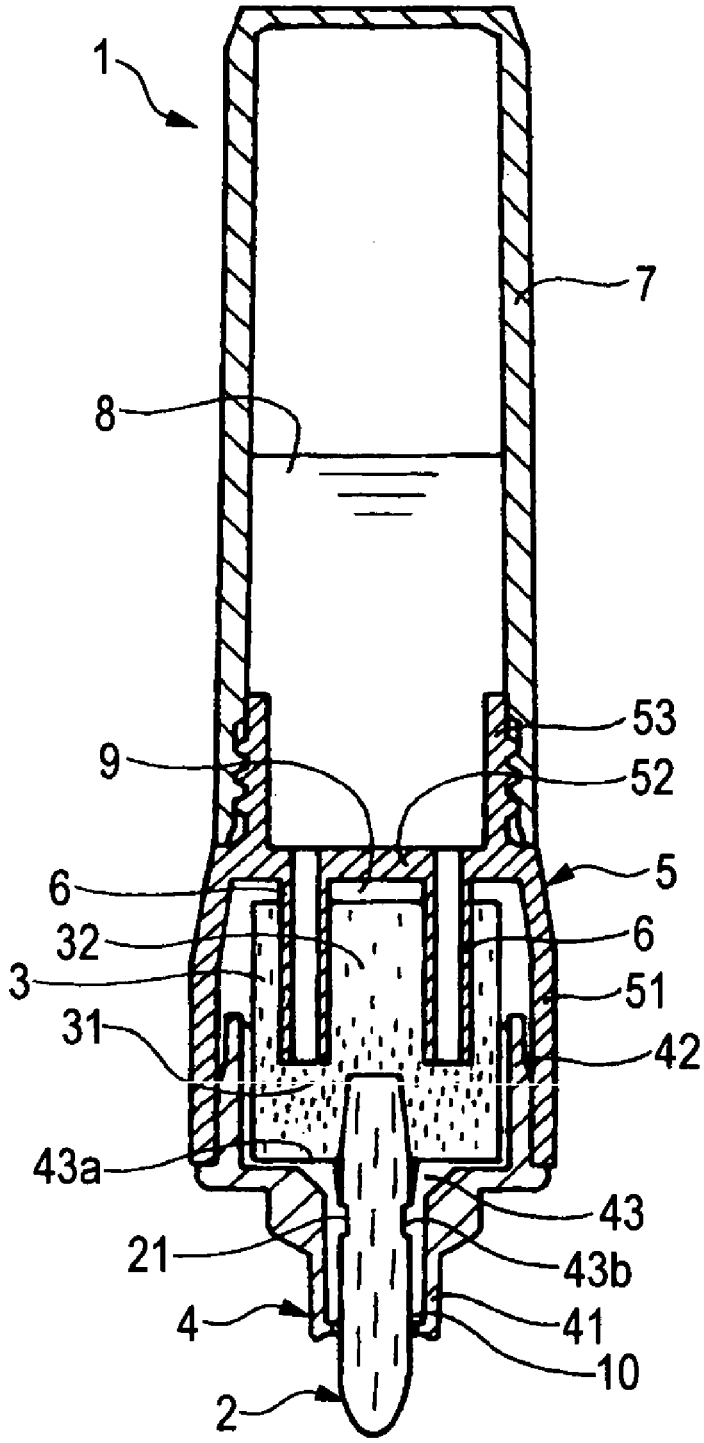
FIG. 13 is a longitudinally cross-sectional view illustrating a pentip downward-pointing state of a ninth embodiment of the invention.

FIG. 13 shows a ninth embodiment of the invention.

This embodiment is a modification of the first embodiment. This embodiment differs from the first embodiment in that each of the front ends of the communicating tubes 6 aligns with a surface which is perpendicular to a longitudinal axis of the writing implement. Incidentally, the remaining components of this embodiment are similar to the corresponding components of the first embodiment. Thus, the description of the remaining components of the ninth embodiment is omitted herein.

Tenth Embodiment

Figure 14:
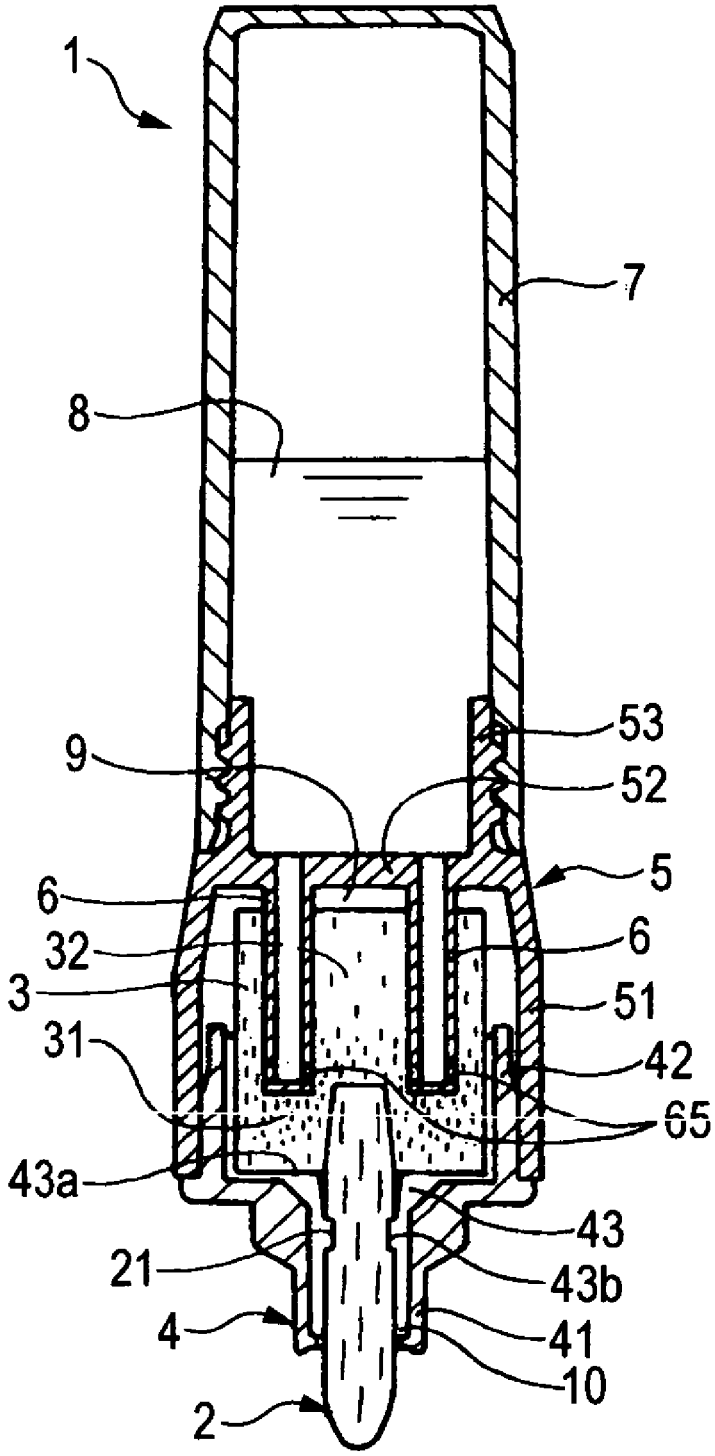
FIG. 14 is a longitudinally cross-sectional view illustrating a pentip downward-pointing state of a tenth embodiment of the invention.

FIG. 14 shows a tenth embodiment of the invention. This embodiment is a modification of the first embodiment. This embodiment differs from the first embodiment in that each of the front ends of the communicating tubes 6 aligns with a surface which is perpendicular to a longitudinal axis of the writing implement and that each of the front end of the communicating tube 6 does not open to frontward direction of the longitudinal direction, but opens to a radially outward direction of the writing implement via pluralities of window holes 65. Incidentally, the remaining components of this embodiment are similar to the corresponding components of the first embodiment. Thus, the description of the remaining components of the tenth embodiment is omitted herein.

Eleventh Embodiment

Figure 15:
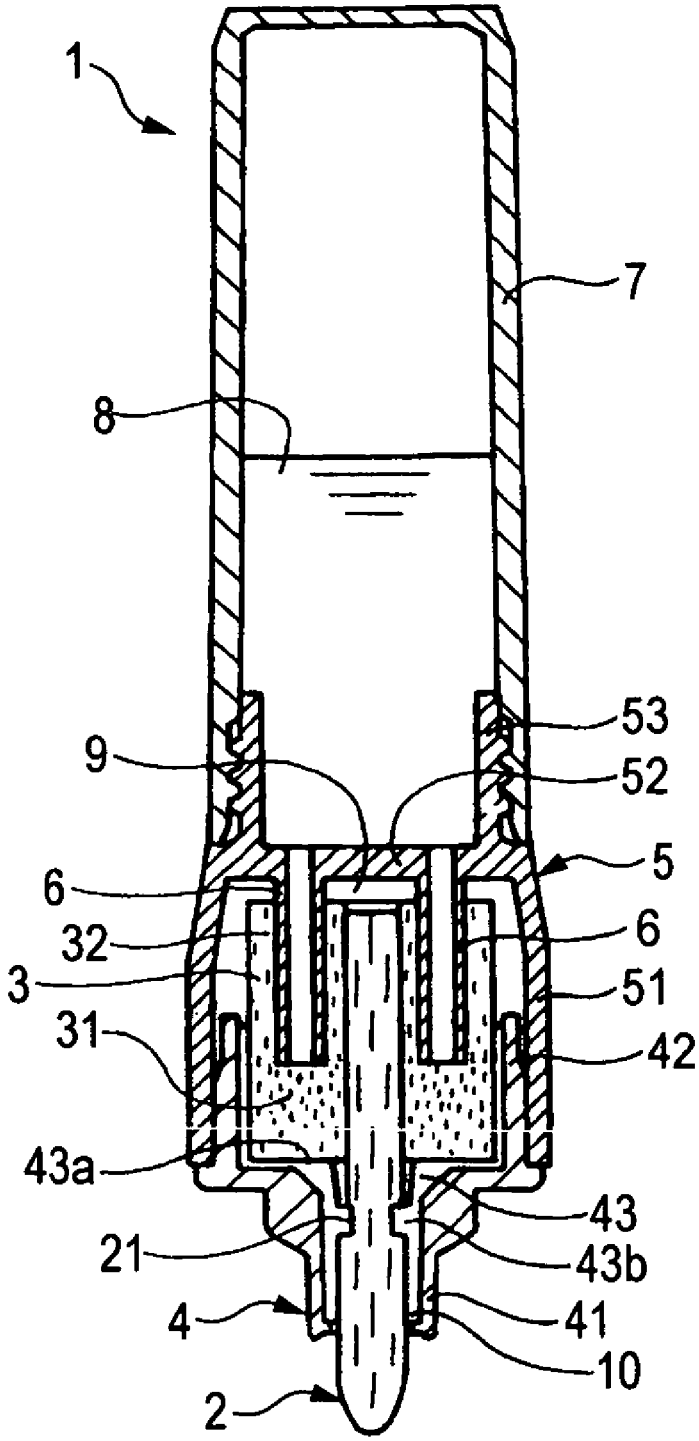
FIG. 15 is a longitudinally cross-sectional view illustrating a pentip downward-pointing state of an eleventh embodiment of the invention.

FIG. 15 shows an eleventh embodiment of the invention. This embodiment differs from the first embodiment in that each of the front ends of the communicating tubes 6 aligns with a surface which is perpendicular to a longitudinal axis of the writing implement and that a rear portion of the pentip 2 is inserted in the through hole of a axial core of the ink occluding element 3 and the rear end of the pentip 2 is positioned at rearward of an interior of the ink occluding element 3 (that is, an interior of a rear half of the ink occluding element 3). Incidentally, the remaining components of this embodiment are similar to the corresponding components of the first embodiment. Thus, the description of the remaining components of the eleventh embodiment is omitted herein.

While there has been described in connection with the preferred embodiments of the present inventions it will be obvious to those skilled in the art that various changes and modification may be made therein without departing from the present invention, and it is aimed, therefore, to cover in the appended claim all such changes and modifications as fall within the true spirit and scope of the present invention.

What is claimed is:

1. A direct-fluid-supply writing implement comprising:
- a pentip;
- an ink occluding element connected to a rear end of the pentip, the ink occluding element including:
  - a high density portion; and
  - a low density portion continuously connected to a rear of the high density portion;
- an ink tank disposed at rear of the ink occluding element and adapted to directly store ink; and
- a plurality of communicating tubes connecting the ink tank with the ink occluding element, the respective communicating tubes including an opened front end,
- wherein the front end of the communicating tube and the rear end of the pentip connect with the high-density portion.

2. The direct-fluid-supply writing implement according to claim 1, wherein each of the communicating tubes penetrates through an inside of the low density portion.

3. The direct-fluid-supply writing implement according to claim 1, wherein when the front end of each of the communicating tubes is inserted into the ink occluding element from a rear end thereof, the front end of each of the communicating tubes frontwardly compresses an inside of the ink occluding element to thereby form the high density portion in the ink occluding element in vicinity of each of the front end of the communicating tubes.

4. The direct-fluid-supply writing implement according to claim 1, wherein the high density portion is formed by radially and inwardly compressing an outer surface of the ink occluding element.

5. The direct-fluid-supply writing implement according to claim 1, wherein the high density portion is formed by rearwardly compressing a front end surface of the ink occluding element.

6. The direct-fluid-supply writing implement according to claim 1, wherein the ink occluding element includes:
- a first ink occluding member, whose density is set at a high value; and
- a second ink occluding member, whose density is set at a low value,
- wherein the first occluding member constitutes the high density portion, while the second ink occluding member constitutes the low density portion.

7. The direct-fluid-supply writing implement according to claim 1, wherein an ink absorbing element having a capillary gap is disposed in each of the communicating tubes, and
- capillary force of the ink absorbing element is set to be less than that of the high density portion.

8. The direct-fluid-supply writing implement according to claim 1, wherein axial positions of the front ends of the communicating tubes are set to be same each other.

9. The direct-fluid-supply writing implement according to claim 1, wherein the front end of each of the communicating tubes is placed in vicinity of the rear end of the pentip.

10. The direct-fluid-supply writing implement according to claim 1, wherein the rear end of the pentip connects with the front end of each of the communicating tubes through the high density portion so that ink is flowable therebetween.

11. The direct-fluid-supply writing implement according to claim 1, wherein a front end surface and a rear end surface of the ink occluding element communicate with ambient air.

12. The direct-fluid-supply writing implement according to claim 1, wherein side walls of the communicating tubes are connected to one another.

13. A direct-fluid-supply writing implement comprising:
- a pentip;
- an ink occluding element connected to a rear end of the pentip;
- an ink tank disposed in a rear of the ink occluding element and adapted to directly store ink; and
- a plurality of communicating tubes connecting the ink tank with the ink occluding element, each of the communicating tubes including an opened front end;
- wherein the front end of each of the communicating tubes is placed in the ink occluding element,
- wherein axial positions of the front ends of the communicating tubes are set to be the same as each other, and
- wherein the front end of each of the communicating tubes is frontwardly inserted into the ink occluding element from the rear end thereof, and frontwardly compresses an inside of the ink occluding element, so that a density of a first part of the ink occluding element in vicinity of the front end of each of the communicating tubes is set higher than a density of a second part of the ink occluding element, which is other than the first part of the ink occluding element.

14. The direct-fluid-supply writing implement according to claim 13, wherein a void ratio of the second part of the ink occluding element is 70% or more and 95% or less, and a gap between the void ratio of the second part of the ink occluding element and a void ratio of the first part of the ink occluding element is 7% or more.

15. The direct-fluid-supply writing implement according to claim 13, wherein the front end of each of the communicating tubes is formed into a pointed shape.

16. The direct-fluid-supply writing implement according to claim 15, wherein the front end of each of the communicating tubes is constituted by an inclined cut surface that includes the front end opening portion thereof.

17. A direct-fluid-supply writing implement comprising:

a pentip;

an ink occluding element connected to a rear end of the pentip;

an ink tank disposed in a rear of the ink occluding element and adapted to directly store ink; and a plurality of communicating tubes connecting the ink tank with the ink occluding element, each of the communicating tubes including an opened front end;

wherein the front end of each of the communicating tubes is placed in the ink occluding element, wherein axial positions of the front ends of the communicating tubes are set to be the same as each other, and wherein a front end surface and a rear end surface of the ink occluding element communicate with ambient air.

18. A direct-fluid-supply writing implement comprising:

a pentip;

an ink occluding element connected to a rear end of the pentip;

an ink tank disposed in a rear of the ink occluding element and adapted to directly store ink; and a plurality of communicating tubes connecting the ink tank with the ink occluding element, each of the communicating tubes including an opened front end;

wherein the front end of each of the communicating tubes is placed in the ink occluding element, wherein axial positions of the front ends of the communicating tubes are set to be the same as each other, and wherein an ink absorbing element having a capillary gap is disposed in each of the communicating tubes.

19. The direct-fluid-supply writing implement according to claim 1, wherein a void ratio of the low density portion is 70% or more and 90% or less, a gap between the void ratio of the low density portion and a void ratio of the high density portion is 7% or more.

20. A direct-fluid-supply writing implement comprising:

a pentip;

an ink occluding element connected to a rear end of the pentip;

an ink tank disposed in a rear of the ink occluding element and adapted to directly store ink; and a plurality of communicating tubes connecting the ink tank with the ink occluding element, each of the communicating tubes including an opened front end;

wherein the front end of each of the communicating tubes is placed in vicinity of the rear end of the pentip in the ink occluding element, and wherein the front end of each of the communicating tubes is frontwardly inserted into the ink occluding element from the rear end thereof, and frontwardly compresses an inside of the ink occluding element, so that a density of a first part of the ink occluding element in vicinity of the front end of each of the communicating tubes is set higher than a density of a second part of the ink occluding element, which is other than the first part of the ink occluding element.

21. The direct-fluid-supply writing implement according to claim 20, wherein the front end of each of the communicating tubes is formed into a pointed shape.

22. The direct-fluid-supply writing implement according to claim 21, wherein the front end of each of the communicating tubes is constituted by an inclined cut surface that includes the front end opening portion thereof.

23. The direct-fluid-supply writing implement according to claim 20, wherein a void ratio of the second part of the ink occluding element is 70% or more and 95% or less, and a gap between the void ratio of the second part of the ink occluding element and a void ratio of the first part of the ink occluding element is 7% or more.

24. A direct-fluid-supply writing implement comprising:

a pentip;

an ink occluding element connected to a rear end of the pentip;

an ink tank disposed in a rear of the ink occluding element and adapted to directly store ink; and a plurality of communicating tubes connecting the ink tank with the ink occluding element, each of the communicating tubes including an opened front end;

wherein the front end of each of the communicating tubes is placed in vicinity of the rear end of the pentip in the ink occluding element;

wherein axial positions of the front ends of the communicating tubes are set to be the same as each other, and wherein the front end of each of the communicating tubes is frontwardly inserted into the ink occluding element from the rear end thereof, and frontwardly compresses an inside of the ink occluding element, so that a density of a first part of the ink occluding element in vicinity of the front end of each of the communicating tubes is set higher than a density of a second part of the ink occluding element, which is other than the first part of the ink occluding element.

25. The direct-fluid-supply writing implement according to claim 24, wherein the front end of each of the communicating tubes is formed into a pointed shape.

26. The direct-fluid-supply writing implement according to claim 25, wherein the front end of each of the communicating tubes is constituted by an inclined cut surface that includes the front end opening portion thereof.

27. The direct-fluid-supply writing implement according to claim 24, wherein a void ratio of the second part of the ink occluding element is 70% or more and 95% or less, and a gap between the void ratio of the second part of the ink occluding element and a void ratio of the first part of the ink occluding element is 7% or more.

28. A direct-fluid-supply writing implement comprising:

a pentip;

an ink occluding element connected to a rear end of the pentip;

an ink tank disposed in a rear of the ink occluding element and adapted to directly store ink; and a plurality of communicating tubes connecting the ink tank with the ink occluding element, each of the communicating tubes including an opened front end;

wherein the front end of each of the communicating tubes is placed at an inner front portion of the ink occluding element, wherein the rear end of the pentip is placed in the inner front portion of the ink occluding element, and wherein the front end of each of the communicating tubes is frontwardly inserted into the ink occluding element from the rear end thereof, and frontwardly compresses an inside of the ink occluding element, so that a density of a first part of the ink occluding element in vicinity of the front end of each of the communicating tubes is set higher than a density of a second part of the ink occluding element, which is other than the first part of the ink occluding element.

29. The direct-fluid-supply writing implement according to claim 28, wherein the front end of each of the communicating tubes is formed into a pointed shape.

30. The direct-fluid-supply writing implement according to claim 29, wherein the front end of each of the communicating tubes is constituted by an inclined cut surface that includes the front end opening portion thereof.

31. The direct-fluid-supply writing implement according to claim 28, wherein a void ratio of the second part of the ink occluding element is 70% or more and 95% or less, and a gap between the void ratio of the second part of the ink occluding element and a void ratio of the first part of the ink occluding element is 7% or more.

32. A direct-fluid-supply writing implement comprising:

a pentip;

an ink occluding element connected to a rear end of the pentip;

an ink tank disposed in a rear of the ink occluding element and adapted to directly store ink; and a plurality of communicating tubes connecting the ink tank with the ink occluding element, each of the communicating tubes including an opened front end;

wherein the front end of each of the communicating tubes is placed in the ink occluding element, and wherein the front end of each of the communicating tubes is frontwardly inserted into the ink occluding element from the rear end thereof, and frontwardly compresses an inside of the ink occluding element, so that a density of a first part of the ink occluding element in vicinity of the front end of each of the communicating tubes is set higher than a density of a second part of the ink occluding element, which is other than the first part of the ink occluding element.

33. The direct-fluid-supply writing implement according to claim 32, wherein the front end of each of the communicating tubes is formed into a pointed shape.

34. The direct-fluid-supply writing implement according to claim 33, wherein the front end of each of the communicating tubes is constituted by an inclined cut surface that includes the front end opening portion thereof.

35. The direct-fluid-supply writing implement according to claim 32, wherein a void ratio of the second part of the ink occluding element is 70% or more and 95% or less, and a gap between the void ratio of the second part of the ink occluding element and a void ratio of the first part of the ink occluding element is 7% or more.

36. A direct-fluid-supply writing implement comprising:

a pentip;

an ink occluding element connected to a rear end of the pentip;

an ink tank disposed in a rear of the ink occluding element and adapted to directly store ink; and a plurality of communicating tubes connecting the ink tank with the ink occluding element, each of the communicating tubes including an opened front end;

wherein the front end of each of the communicating tubes is placed in vicinity of the rear end of the pentip in the ink occluding element, and wherein a front end surface and a rear end surface of the ink occluding element communicate with ambient air.

37. A direct-fluid-supply writing implement comprising:

a pentip;

an ink occluding element connected to a rear end of the pentip;

an ink tank disposed in a rear of the ink occluding element and adapted to directly store ink; and a plurality of communicating tubes connecting the ink tank with the ink occluding element, each of the communicating tubes including an opened front end;

wherein the front end of each of the communicating tubes is placed in vicinity of the rear end of the pentip in the ink occluding element, wherein axial positions of the front ends of the communicating tubes are set to be the same as each other, and wherein a front end surface and a rear end surface of the ink occluding element communicate with ambient air.

38. A direct-fluid-supply writing implement comprising:

a pentip;

an ink occluding element connected to a rear end of the pentip;

an ink tank disposed in a rear of the ink occluding element and adapted to directly store ink; and a plurality of communicating tubes connecting the ink tank with the ink occluding element, each of the communicating tubes including an opened front end;

wherein the front end of each of the communicating tubes is placed at an inner front portion of the ink occluding element, wherein the rear end of the pentip is placed in the inner front portion of the ink occluding element, and wherein a front end surface and a rear end surface of the ink occluding element communicate with ambient air.

39. A direct-fluid-supply writing implement comprising:

a pentip;

an ink occluding element connected to a rear end of the pentip;

an ink tank disposed in a rear of the ink occluding element and adapted to directly store ink; and a plurality of communicating tubes connecting the ink tank with the ink occluding element, each of the communicating tubes including an opened front end;

wherein the front end of each of the communicating tubes is placed in the ink occluding element, and wherein a front end surface and a rear end surface of the ink occluding element communicate with ambient air.

40. A direct-fluid-supply writing implement comprising:

a pentip;

an ink occluding element connected to a rear end of the pentip;

an ink tank disposed in a rear of the ink occluding element and adapted to directly store ink; and a plurality of communicating tubes connecting the ink tank with the ink occluding element, each of the communicating tubes including an opened front end;

wherein the front end of each of the communicating tubes is placed in vicinity of the rear end of the pentip in the ink occluding element, and wherein an ink absorbing element having a capillary gap is disposed in each of the communicating tubes.

41. A direct-fluid-supply writing implement comprising:

a pentip;

an ink occluding element connected to a rear end of the pentip;

an ink tank disposed in a rear of the ink occluding element and adapted to directly store ink; and a plurality of communicating tubes connecting the ink tank with the ink occluding element, each of the communicating tubes including an opened front end;

wherein the front end of each of the communicating tubes is placed in vicinity of the rear end of the pentip in the ink occluding element, wherein axial positions of the front ends of the communicating tubes are set to be the same as each other, and wherein an ink absorbing element having a capillary gap is disposed in each of the communicating tubes.

42. A direct-fluid-supply writing implement comprising:

a pentip;

an ink occluding element connected to a rear end of the pentip;

an ink tank disposed in a rear of the ink occluding element and adapted to directly store ink; and a plurality of communicating tubes connecting the ink tank with the ink occluding element, each of the communicating tubes including an opened front end;

wherein the front end of each of the communicating tubes is placed at an inner front portion of the ink occluding element, wherein the rear end of the pentip is placed in the inner front portion of the ink occluding element, and wherein an ink absorbing element having a capillary gap is disposed in each of the communicating tubes.

43. A direct-fluid-supply writing implement comprising:

a pentip;

an ink occluding element connected to a rear end of the pentip;

an ink tank disposed in a rear of the ink occluding element and adapted to directly store ink; and a plurality of communicating tubes connecting the ink tank with the ink occluding element, each of the communicating tubes including an opened front end;

wherein the front end of each of the communicating tubes is placed in the ink occluding element, and wherein an ink absorbing element having a capillary gap is disposed in each of the communicating tubes.

* * * * *